US010865612B2

(12) United States Patent
Elfar

(10) Patent No.: US 10,865,612 B2
(45) Date of Patent: Dec. 15, 2020

(54) DOWNHOLE PULSATION SYSTEM AND METHOD

(71) Applicant: Talal Elfar, Calgary (CA)

(72) Inventor: Talal Elfar, Calgary (CA)

( * ) Notice: Subject to any disclaimer, the term of this patent is extended or adjusted under 35 U.S.C. 154(b) by 0 days.

(21) Appl. No.: 16/503,254

(22) Filed: Jul. 3, 2019

(65) Prior Publication Data

US 2020/0109608 A1 Apr. 9, 2020

Related U.S. Application Data

(63) Continuation-in-part of application No. 16/154,703, filed on Oct. 8, 2018, now Pat. No. 10,648,239.

(51) Int. Cl.

| | |
|---|---|
| ***E21B 7/24*** | (2006.01) |
| ***E21B 21/10*** | (2006.01) |
| *E21B 34/06* | (2006.01) |
| *E21B 17/20* | (2006.01) |

(52) U.S. Cl.

CPC ..... *E21B 21/103* (2013.01); *E21B 7/24* (2013.01); *E21B 17/20* (2013.01); *E21B 34/06* (2013.01)

(58) Field of Classification Search

CPC ..... E21B 7/24
USPC ..... 175/56; 166/386, 177.6
See application file for complete search history.

(56) References Cited

U.S. PATENT DOCUMENTS

| | | | |
|---|---|---|---|
| 8,181,719 | B2 | 5/2012 | Bunney et al. |
| 8,469,104 | B2 | 6/2013 | Downton |
| 9,004,194 | B2 | 4/2015 | Eddison et al. |
| 9,194,208 | B2 | 11/2015 | Schultz et al. |
| 9,273,529 | B2 | 3/2016 | Eddison et al. |
| 9,598,923 | B2 | 3/2017 | Gilleylen et al. |
| 9,702,192 | B2 | 7/2017 | Wicks et al. |
| 9,765,584 | B2 | 9/2017 | Lorenson et al. |
| 9,840,872 | B2 | 12/2017 | Schultz et al. |
| 9,840,873 | B2 | 12/2017 | Schultz et al. |
| 9,903,161 | B2 | 2/2018 | Schultz et al. |
| 9,915,183 | B2 | 3/2018 | Sealy et al. |
| 9,963,937 | B2 | 5/2018 | Prill et al. |
| 2007/0187112 | A1 | 8/2007 | Eddison et al. |
| 2011/0036560 | A1 | 2/2011 | Vail, III et al. |

(Continued)

FOREIGN PATENT DOCUMENTS

| | | | |
|---|---|---|---|
| CA | 2861839 | A1 | 7/2013 |
| CA | 2892254 | A1 | 7/2014 |

(Continued)

*Primary Examiner* — Taras P Bemko
(74) *Attorney, Agent, or Firm* — David Guerra

(57) ABSTRACT

A valve system utilizable with a downhole tool or pulsation assembly for controlling the assembly to reduce friction on a drill string by generating pressure pulsations. The system can include a mandrel cap, and a valve. The valve can include a first end section, a valve bore defined along a longitudinal axis therethrough, one or more ports defined laterally through a sidewall of the valve and in communication with the valve bore, and a second end section defining one or more cavity sections in communication with the valve bore. At least a portion of the valve can be receivable in the cap bore, and the valve bore can be configured to receive fluid from the sub bore or the drill string. The cavity sections can be configured between an open position allowing fluid to pass therethrough and a closed position preventing fluid to pass therethrough.

18 Claims, 19 Drawing Sheets

(56) References Cited

U.S. PATENT DOCUMENTS

| | | | | |
|---|---|---|---|---|
| 2011/0073374 | A1* | 3/2011 | Bunney | E21B 21/103<br>175/107 |
| 2016/0194917 | A1 | 7/2016 | Alali et al. | |
| 2017/0191325 | A1 | 7/2017 | Campbell | |
| 2017/0254182 | A1 | 9/2017 | Gregory et al. | |
| 2018/0038182 | A1 | 2/2018 | Schultz et al. | |

FOREIGN PATENT DOCUMENTS

| | | | |
|---|---|---|---|
| CA | 2922999 | A1 | 5/2015 |
| CA | 2872736 | C | 12/2015 |
| CA | 2960699 | A1 | 3/2016 |
| CA | 2780236 | C | 7/2016 |
| CA | 2680895 | C | 5/2017 |
| CA | 2892971 | C | 9/2017 |
| CA | 2985258 | A1 | 5/2018 |
| WO | 2017197442 | A1 | 11/2017 |

* cited by examiner

DOWNHOLE PULSATION SYSTEM AND METHOD

CROSS-REFERENCE TO RELATED APPLICATION

This application is a continuation-in-part under 35 U.S.C. § 120 based upon co-pending U.S. patent application Ser. No. 16/154,703 filed on Oct. 8, 2018, which is incorporated herein by reference in its entirety.

The present application claims priority under 35 U.S.C. 119(a) to Canada (CA) patent application number 3,036,840 filed on Mar. 15, 2019, which is incorporated herein by reference in its entirety.

BACKGROUND

Technical Field

The present technology relates to a downhole tool system and method, and essentially includes a valve system utilizable with a pulsation system for use in connection with reducing friction acting on a tool string and/or advancing the tool string by generating and utilizing pressure pulsations.

Background Description

Conventional oil and gas drilling involves the rotation of a drill string at the surface which rotates a drill bit mounted to the bottom of the drill string. It is known that to access sub-surface hydrocarbon formations by drilling long bore holes into the earth from the surface. Conventional systems includes advancing a drill bit along the hole, with the drill bit being mounted at the end of a bottom hole assembly (BHA).

During the advancing of the drill bit, friction between the BHA and the well sides can impair the advancing of the drill bit, and in some cases, the BHA can get stuck in the well. This is more the case when drilling angled or horizontal holes. In some circumstances, the weight of the drill string is not sufficient to overcome the friction.

In other drilling operations, a motor may be used to rotate the drill bit. Coiled or flexible tubing can be utilized in many downhole operations, but due to its inherent transverse flexibility, coiled tubing in generally more susceptible to buckling than rigid strings consisting of threadably connected tubulars. One solution to this known disadvantage in coiled tubing is to use extended reach tools in conduction with coiled tubing.

Situations occur where it is more difficult to advance the drill bit in a hydrocarbon formation. These situations can occur during horizontal drilling operations wherein additional loads are placed on the coiled tubing. It is common during some operations that friction lock-up occurs and the entire drill string can get stuck in the well.

The use of cavitation devices are known, such as casing reamer shoes, multi-part stators and counter-weighted devices, to create a pulsation or vibration at the BHA to assist in advancement through the earth or to free the BHA. These known cavitation or vibration devices are not capable of providing controlled, tunable pressure pulses, using a stator rotor configuration. Some of these known cavitation or vibration devices further lack the capability of being utilized with coiled tubing.

While the above-described devices fulfill their respective, particular objectives and requirements, the aforementioned patents do not describe a valve and pulsation system and method that allows reducing friction acting on a tool string by generating and utilizing pressure pulsations.

Therefore, a need exists for a new and novel valve and pulsation system and method that can be used for reducing friction acting on a tool string by generating and utilizing pressure pulsations. In this regard, the present technology substantially fulfills this need. In this respect, the downhole tool system and method according to the present technology substantially departs from the conventional concepts and designs of the known cavitation devices, and in doing so provides an apparatus primarily developed for the purpose of reducing friction acting on a tool string by generating and utilizing pressure pulsations.

BRIEF SUMMARY OF THE PRESENT TECHNOLOGY

In view of the foregoing disadvantages inherent in the known types of cavitation devices now present in the known cavitation devices, the present technology provides a novel downhole pulsation system and method, and overcomes the above-mentioned disadvantages and drawbacks of the known cavitation devices. As such, the general purpose of the present technology, which will be described subsequently in greater detail, is to provide a new and novel downhole pulsation system and method and method which has all the advantages of the known cavitation devices mentioned heretofore and many novel features that result in a downhole pulsation system and method which is not anticipated, rendered obvious, suggested, or even implied by the known cavitation devices, either alone or in any combination thereof.

According to one aspect of the present technology, the present technology can include a valve system that can include a mandrel cap, and a valve. The mandrel cap can at least partially be receivable in a sub bore of a valve sub housing that is operably associated with a drill string and configured to receive a fluid from the drill string. The mandrel cap can include a cap bore extending along a longitudinal axis therethrough. The valve can include a first end section, a valve bore defined along a longitudinal axis therethrough, one or more ports defined laterally through a sidewall of the valve and in communication with the valve bore, and a second end section defining one or more cavity sections in communication with the valve bore. At least a portion of the valve can be receivable in the cap bore, and the valve bore can be configured to receive fluid from the sub bore or the drill string. The cavity sections can be configured between an open position allowing fluid to pass therethrough and a closed position preventing fluid to pass therethrough.

According to another aspect of the present technology, the present technology can include a valve system utilizable with a downhole pulsation assembly. The valve system can include a mandrel cap, a valve assembly, and a pulsation assembly. The mandrel cap can at least partially be receivable in a sub bore of a valve sub housing that is operably associated with a drill string and configured to receive a fluid from the drill string. The mandrel cap can include a cap bore extending along a longitudinal axis therethrough. The valve assembly can include a first unit and a second unit. The first unit can be receivable in the cap bore. The first unit can include a first end section, a first unit bore along a longitudinal axis therethrough, and a second end section defining one or more cavity sections in communication with the first unit bore. The cavity sections of the first unit can be configured between an open position allowing fluid to pass therethrough and a closed position preventing fluid to pass therethrough. The second unit can be at least partially receivable in the cap bore. The second unit can include a first end section, a second unit bore defined along a longitudinal axis therethrough, one or more ports defined laterally through a sidewall of the second unit and in communication with the second unit bore, and a second end section. The pulsation assembly can include a rotor operably linked to the mandrel cap, and a stator. The rotor can have at least one rotor lobe. The stator can include a stator bore axially extending along a longitudinal axis therethrough and configured to allow fluid to pass therethrough, and at least one stator lobe. The stator bore can be configured to receive the rotor.

According to another aspect of the present technology, the present technology can include a method of using a valve system. The method can include the steps of receiving a working fluid from a drill string to a valve bore defined through a valve associated with a valve sub housing that is connected to the drill string. Providing the valve in a configuration selected from the group consisting of:

- a full by-pass configuration where the working fluid is allowed to flow through the valve into a cap bore defined in a mandrel cap that is attachable to the valve;
- a partial by-pass configuration where a first object is receivable from the drill string into the valve bore to contact a wall defining a central bore in the valve that is in communication with the valve bore, so that the object prevents the working fluid from exiting the central bore while allowing a portion of the working fluid to pass around the central bore by way of an outer cavity defined in the valve and in communication with the valve bore; and
- a no by-pass configuration where the first object is in contact with the wall, and where a second object is receivable from the drill string into the valve bore to prevent the working fluid from entering the outer cavity.

Flowing at least a portion of the working fluid through one or more ports defined laterally through a sidewall of the valve and in communication with the valve bore to an annulus defined exterior of the valve.

According to yet another aspect of the present technology, the present technology can include a downhole pulsation system for utilization with a drill string. The system can include a valve sub housing attachable to the drill string. The valve sub housing can include a sub bore axially extending along a longitudinal axis therethrough and configured to allow fluid to pass therethrough. A lobed insert can be fittable to the valve sub housing and locatable inside the sub bore. The lobed insert can include an insert bore axially extending along a longitudinal axis therethrough and configured to allow fluid to pass therethrough, and at least one lobe feature extending into the insert bore. A mandrel cap can include a cap bore axially extending along a longitudinal axis therethrough and configured to allow fluid to pass therethrough, and at least one port defined through the mandrel cap in communication with the cap bore. The mandrel cap can include a portion thereof rotatably receivable in the insert bore of the lobed insert so that the port is alignable with the lobe feature. At least one drive linkage can be operably connected to the mandrel cap to a rotor of a lobed rotor and stator assembly. The lobed insert or the mandrel cap can be configured to intermittently allow fluid to pass from the insert bore through the port upon rotation of the mandrel cap by the rotor.

According to yet another aspect of the present technology, the present technology can include a downhole pulsation system for utilization with a drill string. The system can include a valve assembly including a valve sub housing attachable to the drill string, a lobed insert fittable to the valve sub housing and locatable inside the sub bore, and a mandrel cap rotatably received at least in the valve sub housing. The valve sub housing can include a sub bore axially extending along a longitudinal axis therethrough and configured to allow fluid to pass therethrough. The lobed insert can include an insert bore axially extending along a longitudinal axis therethrough and configured to allow fluid to pass therethrough, and at least one lobe feature extending into the insert bore. The mandrel cap can include a cap bore axially extending along a longitudinal axis therethrough and configured to allow fluid to pass therethrough, and at least one port defined through the mandrel cap in communication with the cap bore. The mandrel cap can have a portion thereof rotatably receivable in the insert bore of the lobed insert so that the port is alignable with the lobe feature. A mandrel can be connectable to the mandrel cap, and can include a mandrel bore axially extending along a longitudinal axis therethrough and configured to allow fluid to pass therethrough from said cap bore, and at least one mandrel port defined through the mandrel in communication with the mandrel bore. The mandrel port can be configured to allow fluid to pass from the mandrel bore to an annulus defined exterior of at least a portion of the mandrel defining the mandrel port. At least one drive linkage can be connectable to the mandrel. A rotor can be connectable to the drive linkage, and the rotor can have at least one rotor lobe. A stator can be connectable to the bottom hole assembly, and the stator can include a stator bore axially extending along a longitudinal axis therethrough and configured to allow fluid to pass therethrough, and at least one stator lobe. The stator bore can be configured receive the rotor. The lobed insert or the mandrel cap can be configured to intermittently allow fluid to pass from the insert bore through the port upon rotation of the mandrel cap by the rotor.

According to still yet another aspect of the present technology, the present technology can include a method of creating drill string pulsation utilizing a downhole pulsation system. The method can include the steps of receiving a working fluid to a sub bore axially defined along a longitudinal axis of a valve sub housing from an axial bore of a drill string coupled to the valve sub housing. Working fluid can then be received to a cap bore defined along a longitudinal axis of a mandrel cap that is rotatably received in an insert bore of a lobed insert located in the sub bore of the valve sub housing. The working fluid can then flow through the cap bore and to a mandrel bore axially defined along a longitudinal axis of a mandrel coupled to the mandrel cap. The working fluid can then flow from the mandrel bore through at least one mandrel port that is in communication with the mandrel bore and an annulus defined exterior of at least a portion of the mandrel defining the mandrel port. A rotor can be rotated within a stator bore of a stator utilizing the flowing of the working fluid through the stator bore. The rotor can be connected to the mandrel. The mandrel cap can be rotated by the rotation of the rotor so that a mandrel port is intermittently obstructed by a lobe feature of the lobe insert.

According to still another aspect of the present technology, the present technology can include a valve system that can include a mandrel cap, a valve body, a valve insert and a biasing element. The mandrel cap can include a cap bore extending along a longitudinal axis therethrough. The valve body can be axially displaceable in the cap bore between an open position and closed position. The valve body can include a valve body bore defined along a longitudinal axis therethrough, and a sealing end section. The valve insert can be located in the cap bore, and can include a valve insert bore defined in a first valve insert end, and a valve plug. The valve insert bore can be configured to receive the sealing end section of the valve body so as to be contactable with the valve plug in the closed position. The biasing element can be configured to urge the valve body to the open position.

According to another aspect of the present technology, the present technology can include a valve system utilizable with a downhole pulsation assembly. The system can include a valve assembly, and a pulsation assembly. The f valve assembly can comprise a valve body axially displaceable in a cap bore of a mandrel cap between an open position and closed position. The valve body can include a valve body bore defined along a longitudinal axis therethrough, and a sealing end section. A valve insert can be located in the cap bore, and can include a valve insert bore defined in a first valve insert end, and a valve plug. The valve insert bore can be configured to receive the sealing end section of the valve body so as to be contactable with the valve plug in the closed position. A biasing element can be configured to urge the valve body to the open position. The pulsation assembly can include a rotor operably linked to the mandrel cap, where the rotor can have at least one rotor lobe. A stator can include a stator bore axially extending along a longitudinal axis therethrough and configured to allow fluid to pass therethrough, and at least one stator lobe. The stator bore can be configured to receive the rotor.

According to yet another aspect of the present technology, the present technology can include a method of using a valve system. The method can comprise the steps of receiving from a drill string at least a portion of a working fluid in a cap bore defined in a mandrel cap. Moving a valve body toward a valve insert upon the valve body receiving a flow of the working fluid or an object from the drill string. The valve body can be slidably received in the cap bore. Contacting a sealing end section of the valve body against a valve plug of the valve insert located in the cap bore to prevent the working fluid from exiting a valve body bore defined through the valve body and past the valve insert. Providing a biasing force to the valve body countering the moving of the valve body toward the valve insert.

In some embodiments, the second end section can include a ring wall separating the cavity sections into an outer cavity and a central bore interiorly concentric with the outer cavity. The outer cavity the said central bore can be in communication with the valve bore.

In some embodiments, the ring wall can be configured to seat against a first object traveling from the drill string to prevent fluid flow entering the central bore.

In some embodiments, the valve bore includes a narrowing section located between the ports and the second end section. The narrowing section can be configured to seat against a second object traveling from the drill string to prevent fluid flow entering the outer cavity and the central bore.

In some embodiments, the narrowing section can have a width or diameter greater than a width or diameter of the ring wall.

In some embodiments, the valve can include a first unit receivable in the cap bore, and a second unit being at least partially receivable in the cap bore. The first unit can include the cavity sections, and the second unit can include the ports.

In some embodiments, the cap bore can include an internal stop edge configured to fix the first unit at a location.

In some embodiments, the second unit being configured to engage with the mandrel cap to secure the second unit to the mandrel cap and the first unit against the internal stop edge.

Some aspects of the present technology may also include a lobed insert fittable to the valve sub housing and locatable inside the sub bore or receivable inside an axial bore of a second housing that is attachable to the valve sub housing. The lobed insert can include an insert bore axially extending along a longitudinal axis therethrough and configured to allow fluid to pass therethrough, and at least one lobe feature extending into the insert bore.

Some aspects of the present technology may also include a sleeve including a sleeve bore axially extending along a longitudinal axis therethrough, and at least one sleeve port defined through the sleeve in communication with the sleeve bore. The sleeve bore can be configured to receive the portion of the mandrel cap defining the port so that the sleeve port is aligned with and in communication with the port of the mandrel cap when the sleeve is assembled on the mandrel cap. There are, of course, additional features of the present technology that will be described hereinafter and which will form the subject matter of the claims attached.

In some embodiments, the present technology can include a mandrel connectable to the mandrel cap and the drive linkage. The mandrel can include a mandrel bore axially extending along a longitudinal axis therethrough and configured to allow fluid to pass therethrough, and at least one mandrel port defined through the mandrel in communication with the mandrel bore and configured to allow fluid to pass from the mandrel bore to an annulus defined exterior of at least a portion of the mandrel defining the mandrel port.

In some embodiments, the drive linkage can be a drive shaft. Further embodiments of the present technology can include the drive shaft as configured to have a predetermined transverse flexibility characteristic.

Some embodiments of the present technology can have the mandrel rotatably supported inside the sub bore of the valve sub housing or inside an axial bore of a second housing that is attachable to the valve sub housing by way of one or more bearings.

Some embodiments can include at least one seal element configured to prevent fluid from entering an annulus downstream of the mandrel cap.

In some embodiments, the present technology can include at least one seal element concentrically located exterior of the mandrel. The seal element can be configured to prevent fluid from entering the annulus defining an exterior of the portion of the mandrel defining the mandrel port.

Some embodiments of the present technology can include a sleeve having a sleeve bore axially extending along a longitudinal axis therethrough, and at least one sleeve port defined through the sleeve in communication with the sleeve bore. The sleeve bore can be configured to receive the portion of the mandrel cap defining the port so that the sleeve port is aligned with and in communication with the port of the mandrel cap when the sleeve is assembled on the mandrel cap.

In some embodiments, the sleeve can include at least one notch defined in an end of the sleeve. The notch can be configured to receive a member protruding from the mandrel cap to prevent rotation of the sleeve about the mandrel cap.

Some embodiments of the present technology can include a collar having a collar bore axially extending along a longitudinal axis therethrough and configured to receive the mandrel cap and secure the sleeve in position on the mandrel cap.

In some embodiments, a narrowed section can be configured in at least one selected from the group consisting of the sub bore, and the cap bore. The narrowed section can be configured to restrict flow of fluid passing therethrough, respectively.

In some embodiments, the lobe feature of the lobe insert is a plurality of lobe features radially arranged and extending into the insert bore.

Some embodiments of the present technology can include a valve system.

In some embodiments, the valve system can include a retainer ring fittable to a first end of the mandrel cap. The retainer ring can be configured to retain the valve body in the cap bore.

In some embodiments, the mandrel cap can include an internal narrowing section associated with the cap bore. The narrowing section can be configured to retain the valve insert.

In some embodiments of the valve system, the biasing element can be located between the valve insert and a portion of the valve body.

In some embodiments of the valve system, the biasing element can be configured to receive the sealing end section.

In some embodiments of the valve system, the valve insert can include a valve insert cavity in communication with the valve insert bore. The valve plug can be located in the valve insert cavity to create a valve insert annulus exterior of the valve plug.

In some embodiments of the valve system, the valve body bore is associated with a valve body bore narrowing section configured to produce an axial driving force on the valve body when encountered by a fluid flow or an object from the drill string.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology.

BRIEF DESCRIPTION OF THE DRAWINGS

The present technology will be better understood and objects other than those set forth above will become apparent when consideration is given to the following detailed description thereof. Such description makes reference to the annexed drawings, with phantom lines depicting environmental structure and forming no part of the claimed present technology, wherein:

The same reference numerals refer to the same parts throughout the various figures.

DETAILED DESCRIPTION OF THE PREFERRED EMBODIMENTS

Figure 1:
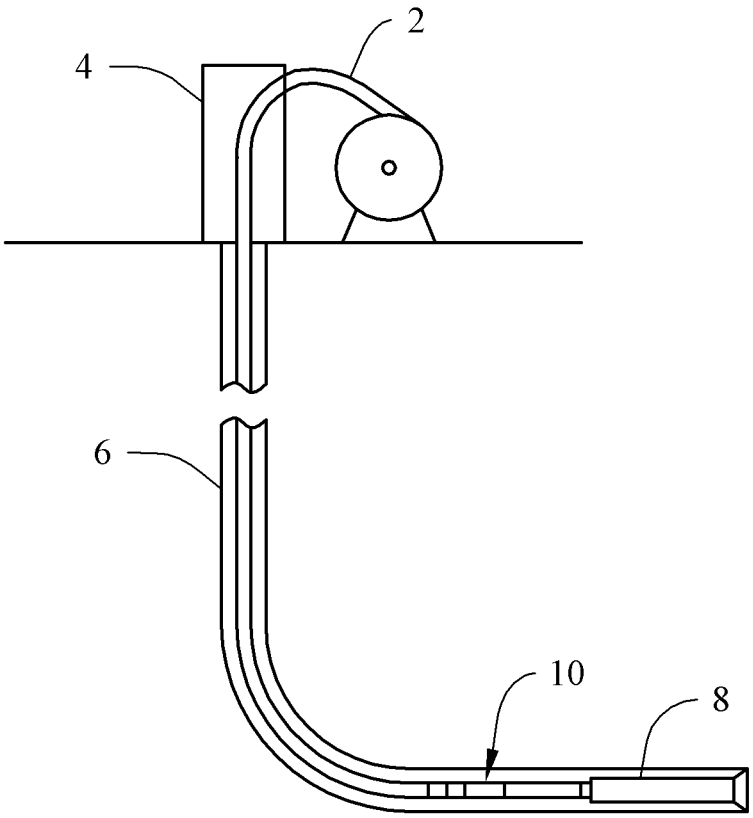
FIG. 1 illustrates a well site system utilizing an embodiment of the downhole pulsation system and method constructed in accordance with the principles of the present technology.

Referring now to the drawings, and particularly to FIGS. 1-32, an embodiment of the downhole tool system and method of the present technology is shown and generally designated by the reference numeral 10.

In FIG. 1, a new and novel downhole pulsation system and method 10 of the present technology for reducing friction acting on a tool string and/or advancing the tool string by generating and utilizing pressure pulsations is illustrated and will be described. In the exemplary, the downhole pulsation system and method 10 can be utilized with a coiled tubing 2 that is associated with a bottom hole assembly (BHA) 8 in a wellbore 6. In typical operation, the coiled tubing 2 is run through a well head assembly 4 for insertion into the wellbore 6. It can be appreciated that the present technology can be utilized with jointed drill pipe or other drill string systems. The coiled tubing can provide fluid, hydraulic, electrical or communications to the BHA 8, and also provides a mechanical drive force to advance and retrieve the BHA 8 from the wellbore 6. The BHA 8 can include, but not limited to, a mud motor, a positive displacement motor (PDM), a measurement while drilling (MWD) tool, telemetry systems or other downhole tool assemblies.

Some benefits and advantages of downhole pulsation system and method 10 can be that it reduces the friction acting on a tool string, such as the coiled tubing 2, being conveyed through a vertical or non-vertical wellbore 6, by way of the generation of pressure pulsations (vibrations). In doing this, the tool string 2 can be conveyed or advanced further along the wellbore 6 before friction lock-up occurs.

In the oilfield industry, lock-up is known as a condition that may occur when a coiled tubing string is run into a horizontal (non-vertical) or highly deviated wellbore. Lock-up occurs when the frictional force encountered by the string running on the wellbore tubular reaches a critical point. Although more tubing may be injected into the wellbore, the end of the tool string cannot be moved farther into the wellbore. Helical buckling of the coiled tubing in the wellbore can be disastrous result of a lock-up condition. Coiled tubing, due to its inherent transverse flexibility, is generally more prone to buckling than strings consisting of threadably connected tubulars or jointed pipes.

Figure 2:
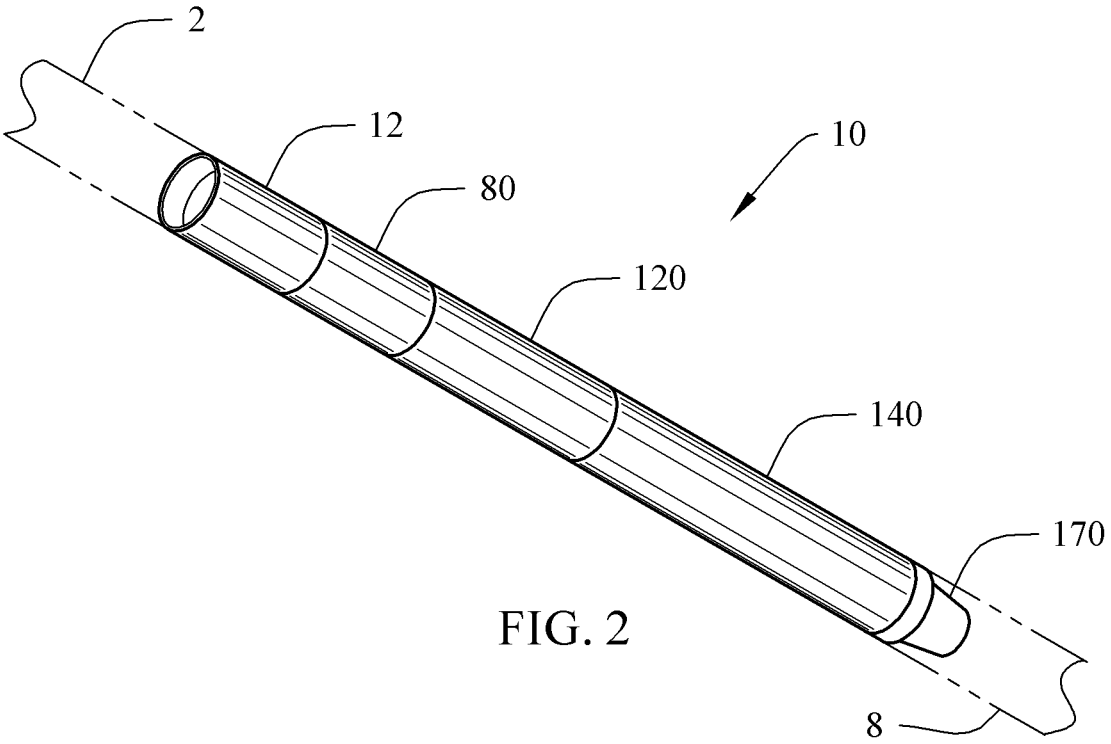
FIG. 2 is a perspective view of an assembled downhole pulsation system of the present technology.

Referring to FIG. 2, the downhole pulsation system 10 can include a plurality of assembly connected together to create a single system that is attachable to the coiled tubing 2 and the BHA 8. The downhole pulsation system 10 can include a valve sub assembly 12, a bearing housing assembly 80, a flex shaft housing assembly 120, a rotor/stator assembly 140 and a bottom sub 170. The downhole pulsation system 10, when assembled, can have a smooth outer surface with a diameter less than the wellbore 6, so it can easily be conveyed through the wellhead system 4 and wellbore 6.

The valve sub assembly 12, as best illustrated in FIGS. 3-6, can include a top or valve sub housing 14, a lobed insert 30, a threaded collar 36, a ported sleeve 40, and a mandrel cap 50. The top sub housing 14 defines an axial bore or cavity therethrough, and includes a box connection 16 with internal threading that is capable of engaging with a pin connection of the coiled tubing 2 or other downhole tool. The internal cavity includes a narrowing section 18 that transitions from the box connection 16, which reduces the diameter of the cavity. A main cavity section 20 then transitions from the narrowing section 18, and has a diameter larger than an end of the narrowing section 18, thereby creating a stop edge wall 21.

A secondary cavity section 22 can transition from the main cavity section 20, and which has a diameter larger than the main cavity section 20, thereby creating a stop edge wall 23. Internal threading of a second connection end 24 can be associated with a portion of the secondary cavity section 22. An open end 26 can be adjacent the internal threading of the second connection end 24.

Figure 4:
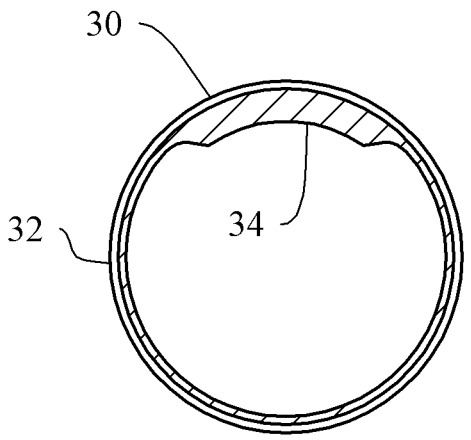
FIG. 4 is a cross-sectional view of the lobed insert of the present technology, taken along line 4-4 in FIG. 3.

The lobed insert 30 defines an axial insert bore or cavity therethrough, and has a diameter allowing it to be received in the secondary cavity section 22 and not the main cavity section 20. The lobed insert 30 includes an external threading portion 32 that is capable of engaging with the internal threading of the second connection end 24, thereby constraining the lobed insert 30 to the top sub housing 14. Extending into the cavity of the lobed insert 30 is at least one lobe feature 34 that projects from an internal surface of the lobed insert 30, as best illustrated in FIG. 4. When assembled, an end of the lobed insert 30 can contact the stop edge 23 of the secondary cavity section 22, thereby securing the lobed insert 30 in place and preventing it from being received in the main cavity section 20. The lobed insert 30 can include interior notches or surfaces that are capable of receiving a tool end for assistance in removal and/or installation of the lobed insert 30 within the secondary cavity section 22 and not the main cavity section 20. It can be appreciated that the lobed insert 30 can include multiple lobe features 34, each with the same or varying thickness, and with the same or varying surface configurations.

Figure 5:
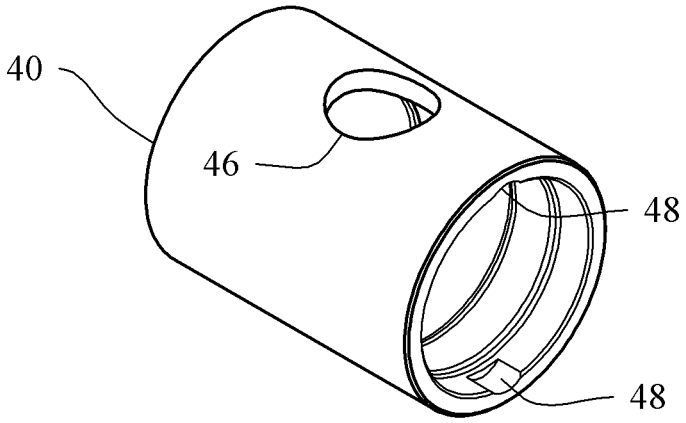
FIG. 5 is a perspective view of the single port sleeve of the present technology.

The ported sleeve 40, as best illustrated in FIG. 5, defines an axial sleeve bore or cavity 42 therethrough, and has a diameter allowing it to be received through the lobed insert 30. The ported sleeve 40 defines a port cavity section 44 in communication with the cavity 42, and at least one port 46 defined through the sidewall of the sleeve 40 and in communication with the port cavity section 44. It can be appreciated that the ported sleeve 40 can include multiple ports 46, each with the same or varying sized openings.

The port cavity section 44 can have a diameter larger than the cavity 42. An end of the sleeve 40, opposite the internal threading section 44, is an open end with notches 48 defined in an internal surface of the sidewall and in communication with the cavity 42 and exterior of the sleeve 40.

Figure 6:
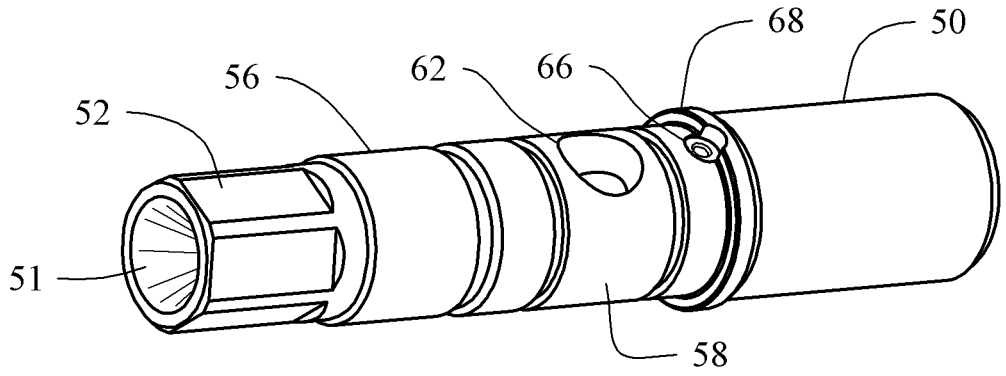
FIG. 6 is a perspective view of the mandrel cap of the present technology.

The mandrel cap 50, as best illustrated in FIG. 6, defines an axial cap bore or cavity therethrough, and includes a first end section 52 featuring exterior planar surfaces, and defining a narrowing cavity section 51. The first end section 52 has a diameter allowing it to be received through the ported sleeve 40 and in the main cavity section 20 of the top sub housing 14, when assembled. The exterior planar surfaces can be arranged to create a geometrical configuration capable of being engaged with a tool for installation, removal or manipulation of the mandrel cap 50.

Adjacent to the first end section 52 is an external threading section 56 capable of engaging with internal threading 38 of the collar 36.

A main cavity section 54 transitions from the narrowing cavity section 51, and has a diameter larger than an end of the narrowing cavity section 51.

Following the external threading section 56 is a port section 58, which includes one or more ports 62 that are defined through the sidewall of the port section 58, and are in communication with the cap cavity 54. It can be appreciated that any number, size and configuration of ports 62 can be utilized. The port section 58 has diameter the same or larger than the first end section 52 or the external threading section 56. The diameter of the port section 58 allows it to be slidably and rotatably received in the ported sleeve 40, so that the port 46 of the ported sleeve 40 is alignable with at least one of the ports 62. Seals 60, 64 can be utilized on the exterior of the port section 58 on either side of the ports 62 to provide fluid tight seal against an interior surface of the ported sleeve 40, when assembled.

The port section 58 can include threaded bores 66 defined therein, each configured to engage with and receive a fastener 74. The number and location of the bores 66 correspond with the number and location of the notches 48 of the ported sleeve 40. When the ported sleeve 40 is assembled with the mandrel cap 50, a head of each of the fasteners 74 is received in a corresponding notch 48, respectively. This can further prevent the ported sleeve 40 from rotating freely with respect to the mandrel cap 50. It can be appreciated that pins, detents, latches, and the like can be used in place of the fastener 74.

Adjacent to the bores 66 is a lip 68 extending outward from an exterior the mandrel cap 50. It can be appreciated that the lip 68 can be a radial lip or at least one projection or tab. The lip 68 has a diameter or height sufficient to produce a stop edge that can contact or abut the end of the ported sleeve 40 when assembled. The mandrel cap 50 includes a second connection end 70 featuring internal threading adjacent to an end thereof.

Figure 7A:
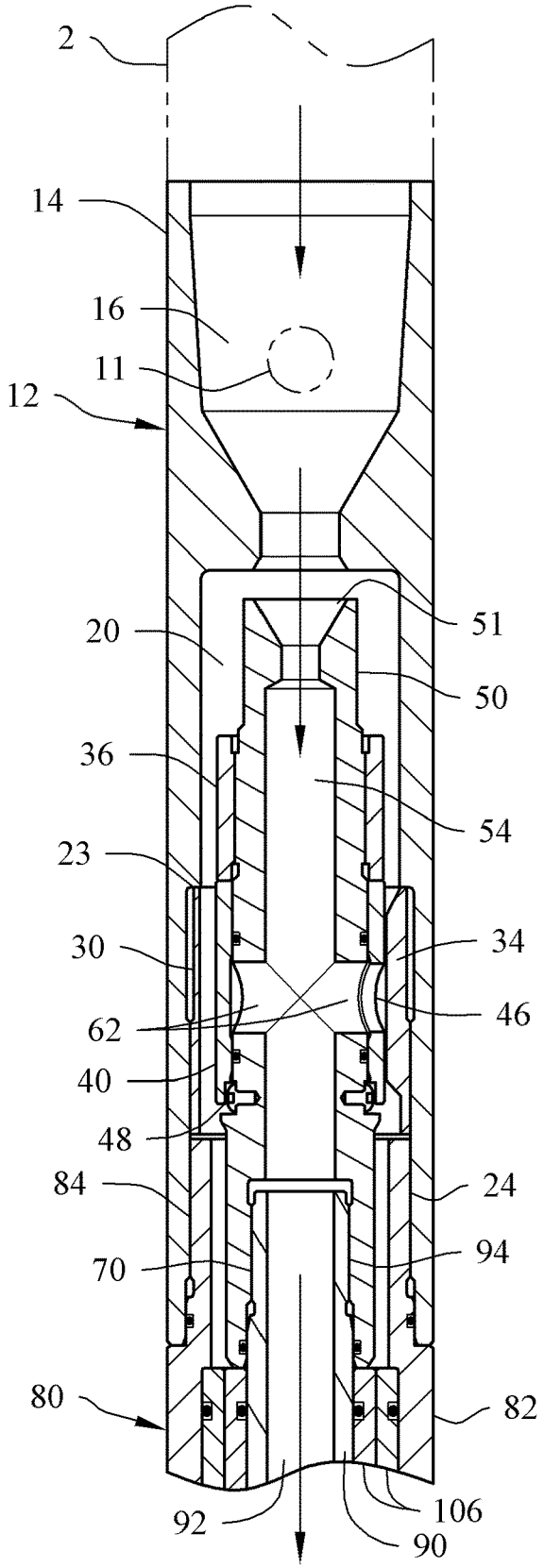
FIGS. 7A and 7B are cross-sectional views of the valve sub assembly in a valve closed position (FIG. 7A) and valve open position (FIG. 7B).
Figure 7B:
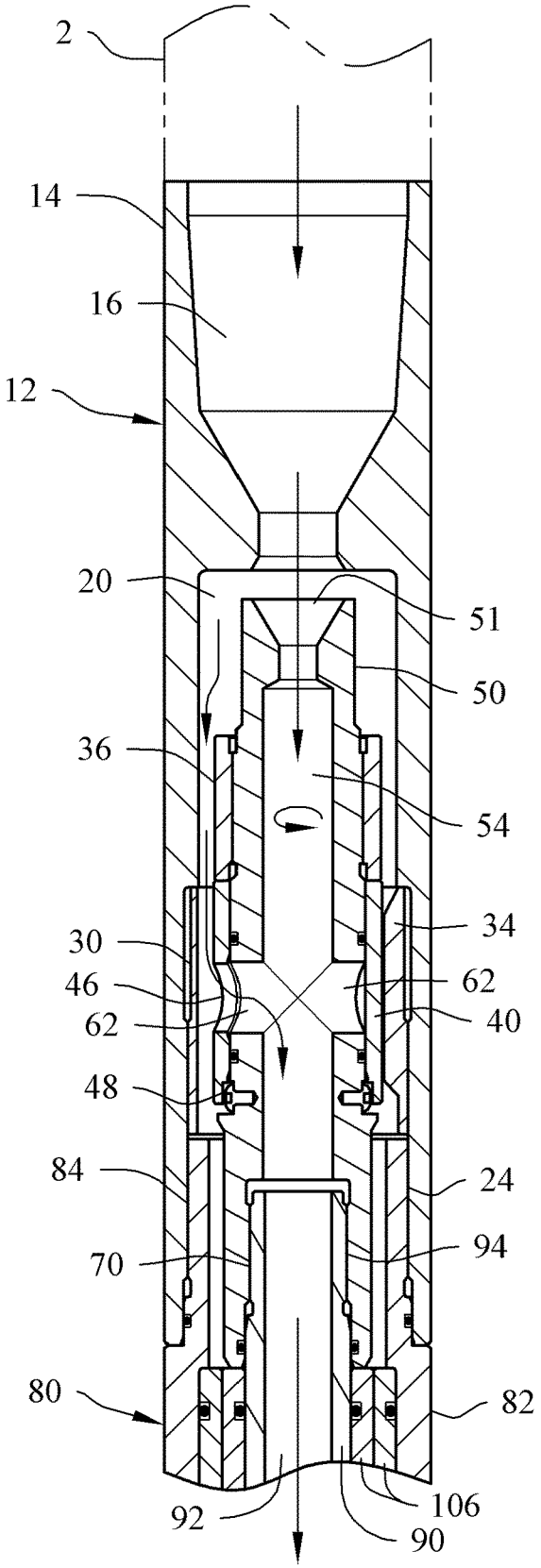

The assembled valve assembly is best illustrated in FIGS. 7A and 7B, which includes the lobed insert 30 securely fitted to the internal threading of the second connection end 24 of the top sub housing 14 so that an end of the lobed insert 30 contacts or is adjacent to the stop edge 23.

The ported sleeve 40 is slidably positioned over the first end section 52 of the mandrel cap 50 and then onto the port section 58 so that the notches 48 receive the heads of the fasteners 74 and the port 46 of the ported sleeve 40 is aligned with at least one of the ports 62 of the mandrel cap 50. Then the collar 36 is slidably received over the first end section 52 and then securely fitted to the external threading section 56 of the first end section 52. The collar 36 can be rotatably engaged with the external threading section 56 to squeeze or clamp the ported sleeve 40 to the mandrel cap 50.

The top sub housing 14 and lobed insert 30 can slidably receive the collar 36, ported sleeve 40 and mandrel cap 50 so that the port 46 of the ported sleeve 40 is aligned with the lobe feature 34 and rotatable within the lobed insert 30. The lobe feature 34 is configured and in sufficient radial proximity to the port 46, to significantly obstruct the passage of fluid into the port 46, as they pass by each other during rotation of the mandrel cap 50, as best illustrated in FIG. 7A. Accordingly, only allowing fluid to pass from the narrowing section 18 or main cavity section 20 of the top sub housing 14 into the open end or narrowing cavity section 51 of the mandrel cap. The lobe feature 34 can have a cylindrical surface that is oriented concentrically with respect to a rotation axis of the mandrel cap 50. The port 46 resides on a cylindrical surface that is oriented concentrically with respect to this rotation axis.

During rotation of the mandrel cap 50, the port 46 will cyclically pass by the lobe feature 34, consequently created cyclic obstruction and non-obstruction of the port 46. During non-obstruction of the port 46 by the lobe feature 34, as best illustrated in FIG. 7B, fluid can freely pass from the main cavity section 20 (annulus between the mandrel cap 50 and the top sub housing 14) of the top sub housing 14 into the port 46 of the ported sleeve 40 and through the port 62 of the mandrel cap 50, and then into the cap cavity 54 of the mandrel cap 50.

The bearing housing assembly 80 includes a bearing housing 82 defining an axial bearing housing bore or cavity therethrough. The bearing housing 82 includes a first connection end 84 featuring external threading capable of being engageable with the internal threading of the second connection end 24 of the top sub housing 14, thereby joining the bearing housing 82 and the top sub housing 14. It can be appreciated that seals can be utilized between the first connection end 84 of the bearing housing 82 and the second connection end 24 of the top sub housing 14. The axial cavity of the bearing housing 82 includes a main cavity section that has a diameter greater than a section of the cavity associated with at least the first connection end 84, thereby creating a stop edge.

Figure 8:
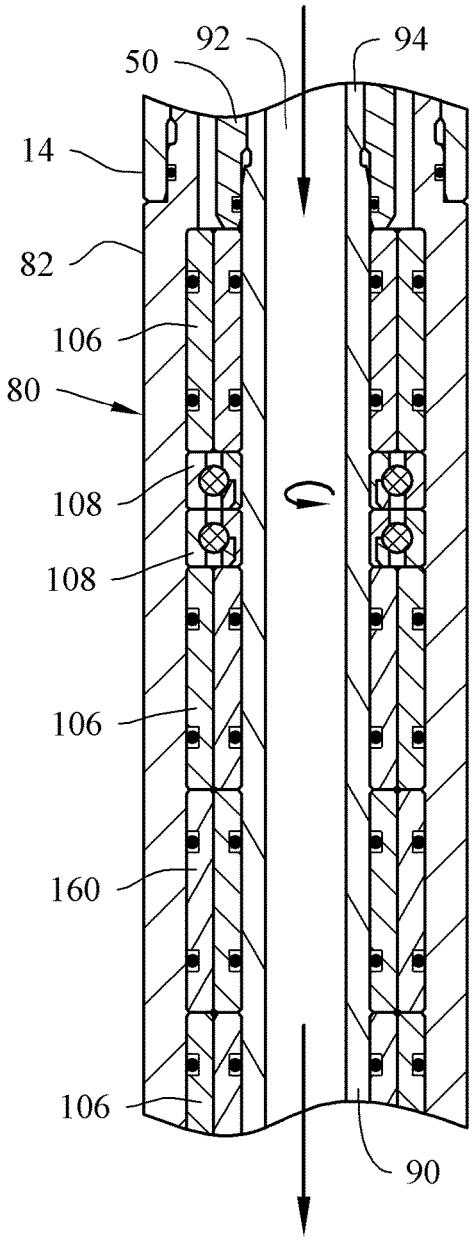
FIG. 8 is a cross-sectional view of the bearing housing assembly with the mandrel of the present technology.
Figure 9:
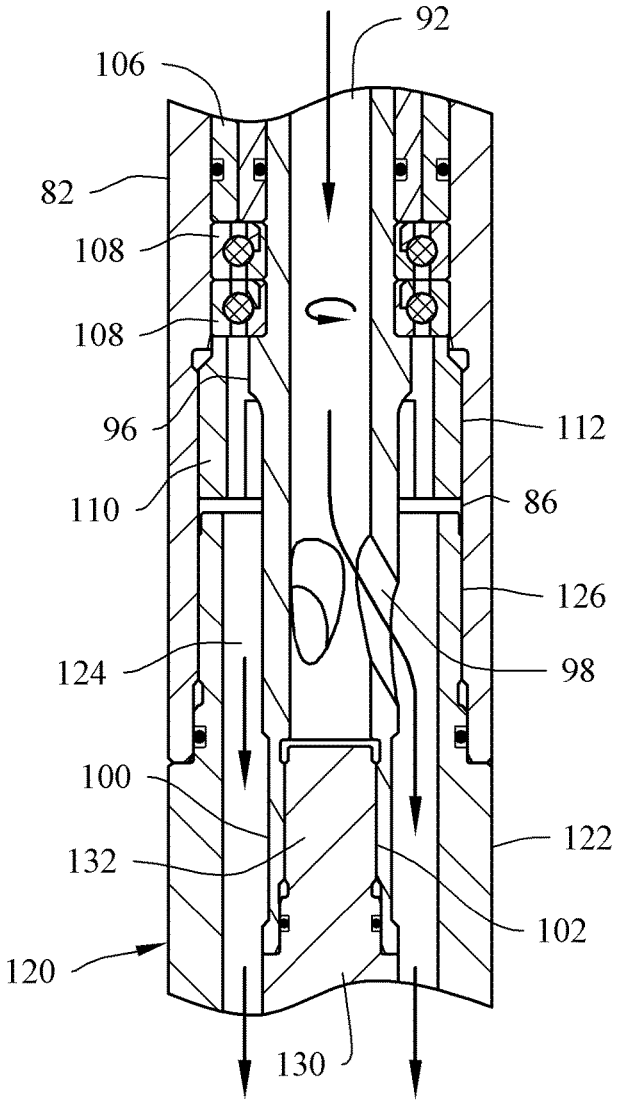
FIG. 9 is a cross-sectional view of the bearing housing assembly and the flex shaft housing assembly with the mandrel and flex shaft of the present technology.

The bearing housing assembly 80 further includes a plurality of seal elements 106 and bearings 108, as best illustrated in FIGS. 8 and 9, axially aligned in a stack configuration and configured to slidably and rotatably receive at least a portion of a mandrel 90. The seal elements 106 can be a set of concentric seals including an exterior seal capable of contacting an interior surface of the bearing housing 82, and an interior seal capable of contacting an exterior surface of a portion of the mandrel 90. The seal elements 106 can be configured to prevent fluid from bypassing a mandrel bore 92 and entering an annulus downstream thereof. The seals utilized in the seal elements 106 can be, but not limited to, O-ring seals made of nitrile or any sealing material utilizable in downhole operations. The bearings 108 can be, but not limited to, a ball bearing, a roller bearing, a plain bearing, a jewel bearing, a fluid bearing, a magnetic bearing, a flexure bearing and the like. In the exemplary, a first seal element 106 is positioned against the stop edge of the bearing housing 82, and adjacent thereto a first bearing set 108 is located. Multiple seal elements 106 can then be positioned adjacent the first bearing set 108, and adjacent thereto can be a second bearing set 108.

The bearing housing 82 can include a second connection end 86 featuring internal threading. A bearing race nut 110 can be received through the second connection end 86 and into the cavity of the bearing housing 82. The bearing race nut 110 can include external threading 112 configured to be engageable with the internal threading of the second connection end 86. The bearing race nut 110 includes an end configured to contact the last sealing bearing 106 or last bearing set 108, respectively depending on the seal element and bearing configuration, when assembled, and clamp all the seal elements 106 and bearings 108 against the stop edge of the bearing housing 82, thereby securing them in place.

The bearing race nut 110 can include interior notches or surfaces that is capable of receiving a tool end for assistance in removal and/or installation of the race nut 110 within the bearing housing 82.

Figure 10:
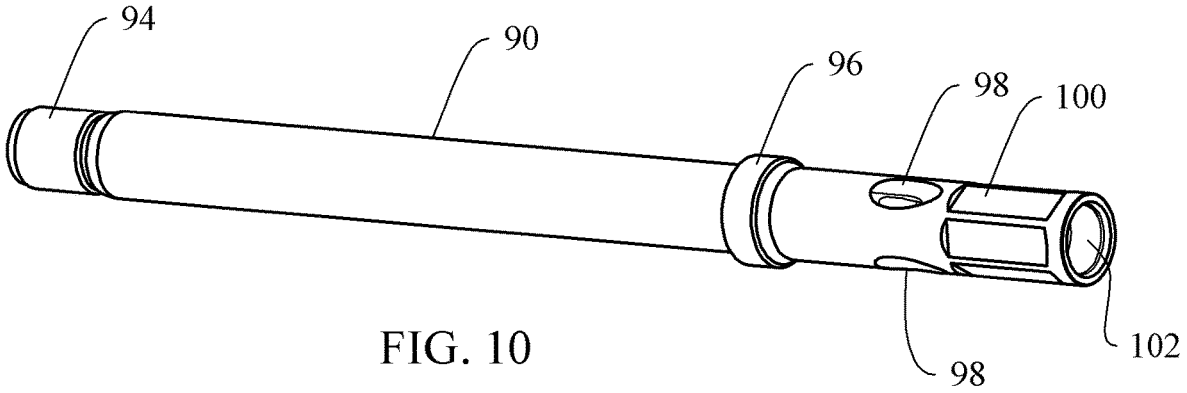
FIG. 10 is a perspective view of the mandrel of the present technology.

The mandrel 90, as best illustrated in FIG. 10, can include a first connection end 94 featuring external threading, a lip 96, a plurality of ports 98, and a second end section 100 featuring exterior planar surfaces. The exterior planar surfaces of the second end section 100 can be arranged to create a geometrical configuration capable of being engaged with a tool for installation, removal or manipulation of the mandrel 90. The mandrel 90 defines an axial mandrel bore or cavity 92 therethrough configured to allow fluid to pass through the mandrel 90. The mandrel 90 is configured to be slidably and rotatably received through the seal elements 106 and bearings 108 so that the external threading of the first connection end 94 is engageable with the internal threading of the second connection end 70 of the mandrel cap 50, thereby coupling the mandrel 90 to the mandrel cap 50. It can be appreciated that seals can be utilized between the first connection end 94 of the mandrel 90 and the second connection end 70 of the mandrel cap 50.

It can be appreciated, as best illustrated in FIGS. 7A and 7B, that the mandrel bore 92 of the mandrel 90 is substantially aligned with the cap cavity 54 of the mandrel cap 50, so that fluid passing through the mandrel cap 50 is capable of passing through the mandrel 90.

The mandrel 90 further includes a lip 96 extending outward from an exterior of the mandrel 90. It can be appreciated that the lip 96 can be a radial lip or at least one projection or tab. The lip 96 has a diameter or height sufficient to produce a stop edge that can contact or abut against the last sealing element 106 or last bearing set 108, respectively depending on the seal element and bearing configuration.

A portion of the mandrel 90 part of or near the second end portion 100 includes one or more angled ports 98 defined through the sidewall of the mandrel 90. Adjacent to or part of the second end portion 100 of the mandrel 90 is a second connection end 102 that includes internal threading, and is configured to create an annulus between the bearing housing 82 or the flex shaft housing assembly 120. The ports 98 can be provided at circumferentially spaced positions about a longitudinal axis of the mandrel 90 in which each port 98 extends radially outward for communication between the mandrel bore 92 and the surrounding annulus of the bearing housing 82 or the flex shaft housing assembly 120. Each of the ports 98 can be angled in the direction of fluid flow, as best illustrated in FIG. 9.

Figure 11:
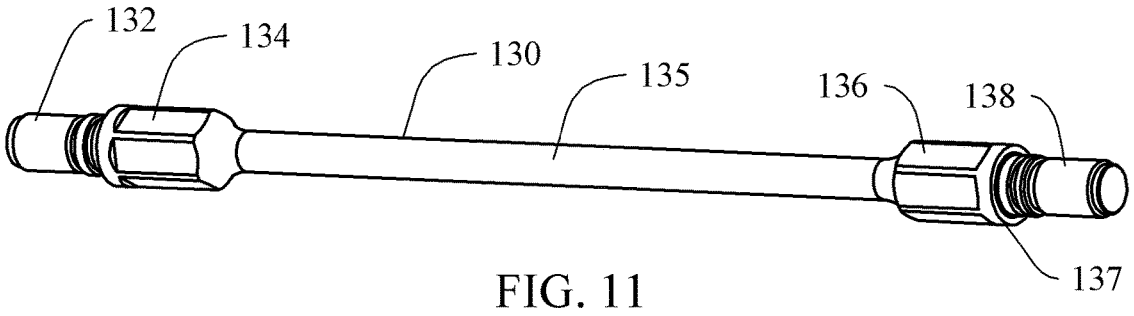
FIG. 11 is a perspective view of the flex shaft of the present technology.
Figure 12:
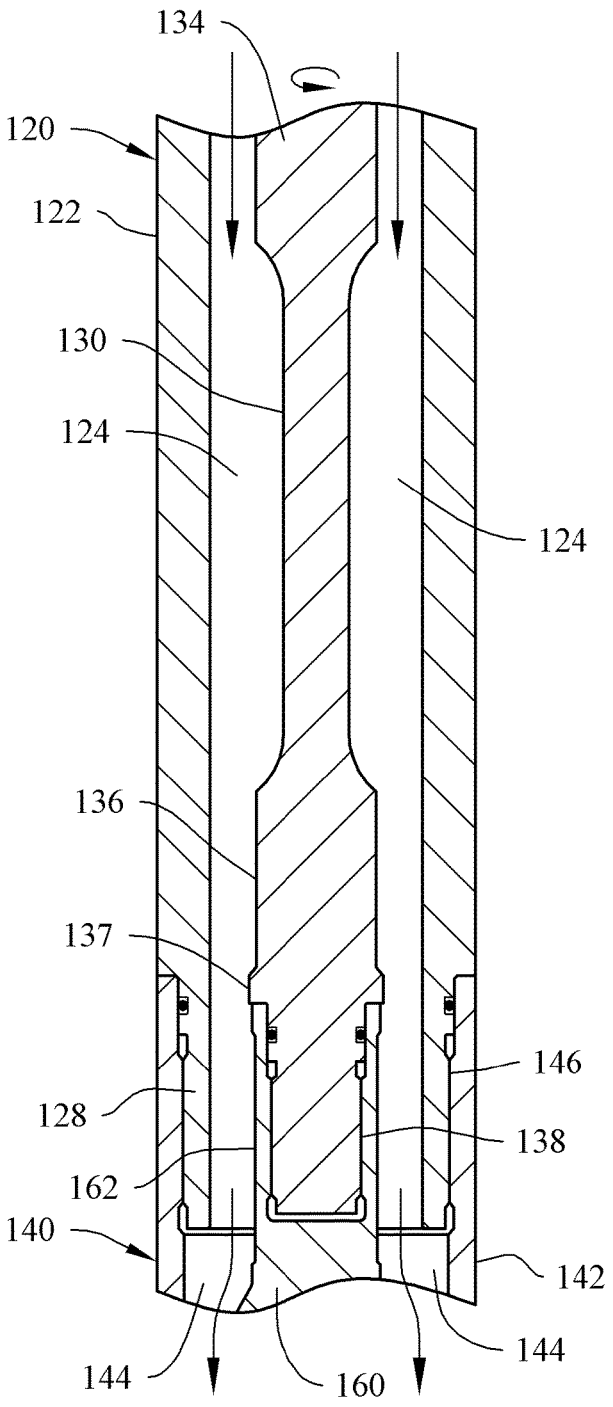
FIG. 12 is a cross-sectional view of the flex shaft housing assembly with the flex shaft of the present technology.

Referring now to FIGS. 9, 11 and 12, the flex shaft housing assembly 120 includes a flex shaft housing 122 defining an axial flex shaft housing bore or cavity 124 therethrough. The flex shaft housing 122 can include a first connection end 126 featuring external threading capable of being engageable with the internal threading of the second connection end 86 of the bearing housing 82, thereby joining the bearing housing 82 and the flex shaft housing 122. It can be appreciated that seals can be utilized between the first connection end 126 of the flex shaft housing 122 and the second connection end 86 of the bearing housing 82.

A drive shaft or flex shaft 130, as best illustrated in FIG. 11, can include a first connection end 132 featuring external threading, a first set of exterior planar surfaces 134 part of or adjacent with the first connection end 132, a shaft section 135, a second set of exterior planar surfaces 136, and a second connection end 138 featuring external threading. The second set of planar surfaces 136 can be part of or adjacent with the second connection end 138.

The flex shaft 130 is receivable in the flex shaft housing bore 124 of the flex shaft housing 122, and is configured to create an annulus between the flex shaft 130 and the flex shaft housing 122, thereby allowing fluid from the ports 98 to travel therethrough pass the flex shaft 130.

The external threading of the first connection end 132 is capable of being engageable with the internal threading the second connection end 102 of the mandrel 90, thereby joining the mandrel 90 and the flex shaft 130. It can be appreciated that seals can be utilized between the first connection end 94 of the flex shaft 130 and the second connection end 102 of the mandrel 90.

The first and second set of external planar surfaces 134, 136 can be arranged to create a geometrical configuration capable of being engaged with a tool for installation, removal or manipulation of the flex shaft 130.

The flex shaft 130 is configured or capable of undergoing nutation as well as rotation, this can be accomplished with the flex shaft 130 having sufficient transverse flexibility. The shaft section 135 can have a diameter less than the first and second ends or sufficient enough to provide the transverse flexibility required of the present technology.

Figure 13:
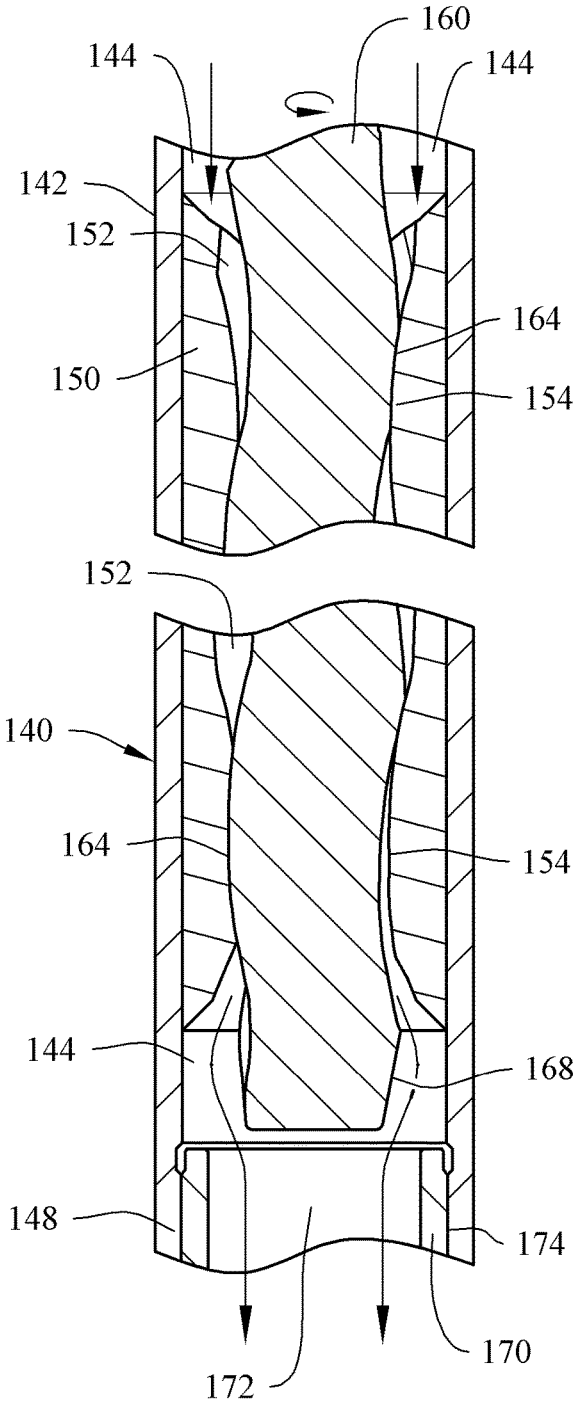
FIG. 13 is a cross-sectional view of the rotor/stator assembly with the stator and rotor of the present technology.
Figure 14:
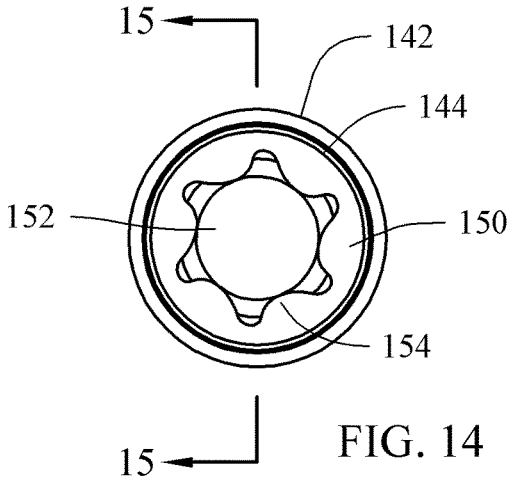
FIG. 14 is a side view of the stator housing with the stator of the present technology.
Figure 15:
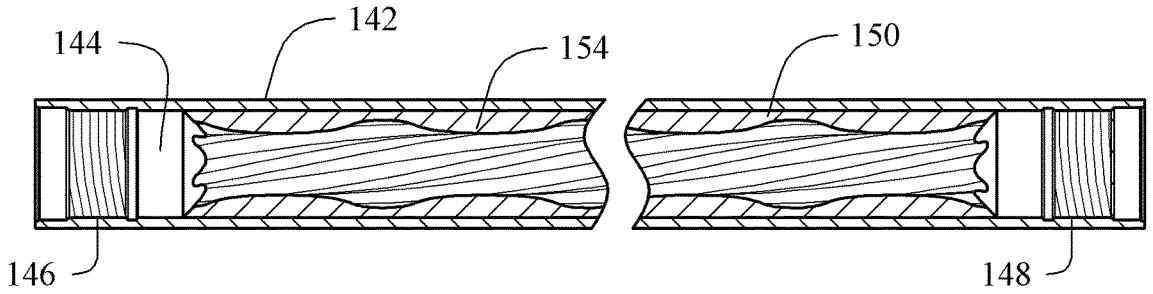
FIG. 15 is a cross-sectional view of the stator housing and stator of the present technology, taken along line 15-15 in FIG. 14.

Referring to FIGS. 12-16, the rotor/stator assembly 140 includes a stator housing 142, a stator 150, and a rotor 160. The rotor/stator assembly 140 can be configured to be a progressing-cavity stator/rotor combination provides rotational power to turn the rotor relative to the stator. The stator housing 142, as best illustrated in FIGS. 12, 14 and 15, defines an axial stator housing bore or cavity 144 therethrough, and includes a first connection end 146 featuring internal threading capable of being engageable with the external threading of the second connection end 128 of the flex shaft housing 122, thereby joining the flex shaft housing 122 and the stator housing 142. It can be appreciated that seals can be utilized between the first connection end 146 of the stator housing 142 and the second connection end 128 of the flex shaft housing 122. A second connection end 148 of the stator housing 142, as best illustrated in FIGS. 13 and 15 can feature internal threading.

The stator 150 can be received in the stator housing bore 144 of the stator housing 142 and fittingly secured thereto, so that the stator 150 and stator housing 142 is substantially a single unit. The stator 150 can be a tubular extension defining an axial stator bore or cavity 152 therethrough, and extending in the longitudinal direction of the stator housing 142. The stator bore 152 is in communication with the stator housing bore 144, so as to receive fluid from the flex shaft housing cavity 124. The stator 150 can include multiple lobes 154 extending into the stator bore 152.

The rotor 160 includes a first connection end 162 featuring internal threading capable of being engageable with the external threading of the second connection end 138 of the flex shaft 130, thereby joining the flex shaft 130 and the rotor 160. It can be appreciated that seals can be utilized between the first connection end 162 of the rotor 160 and the second connection end 138 of the flex shaft 130.

Figure 16:
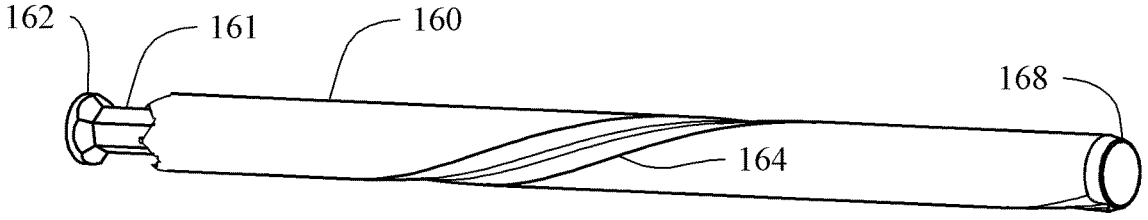
FIG. 16 is a perspective view of the rotor of the present technology.

As best illustrated in FIG. 16, the rotor 160 can include exterior planar surfaces 161 that can be part of or adjacent the first connection end 162, and a second end 168. The external planar surfaces 161 can be arranged to create a geometrical configuration capable of being engaged with a tool for installation, removal or manipulation of the rotor 160. One or more helical or spiral lobes 164 are configured along a part of a longitudinal length of the rotor 160.

The rotor 160 is slidably and rotatably received in the stator bore 152, with the lobes 154, 164 of the stator 150 and the rotor 160 being complimentary to or with each other. The complimentary configuration of the lobes 154, 164 is capable of rotation of the rotor 160 relative to the stator 150 responsive to a flow of fluid traveling through stator bore 152, as best illustrated in FIG. 13.

Figure 17:
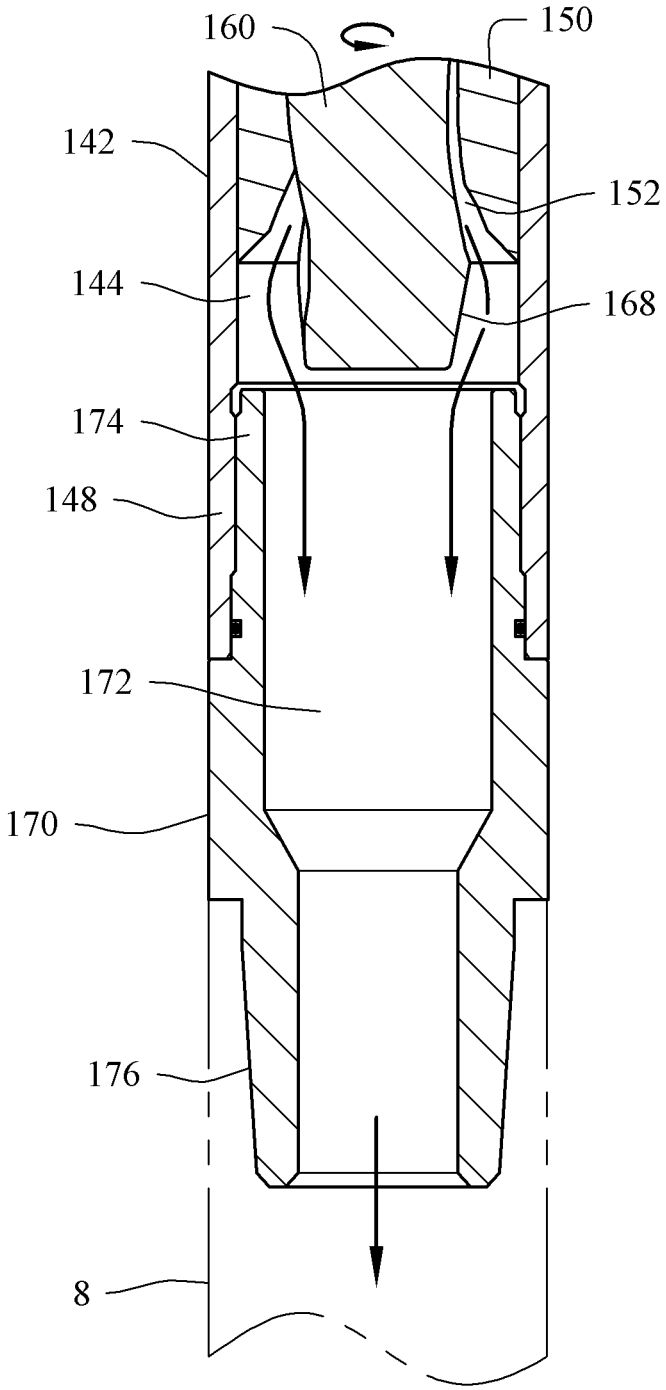
FIG. 17 is a cross-sectional view of the bottom sub of the present technology.

Referring to FIG. 17, the bottom sub 170 defines an axial bottom sub bore or cavity 172 therethrough, and includes a first connection end 174 featuring external threading capable of being engageable with the internal threading of the a second connection end 148 of the stator housing 142, thereby joining the stator housing 142 and the bottom sub 170. It can be appreciated that seals can be utilized between the first connection end 174 of the bottom sub 170 and the second connection end 148 of the stator housing 142.

The bottom sub 170 can include a pin connection end 176 capable of coupling with the BHA 8 or a drill motor top sub.

It can be appreciated that the bearing housing 82, the flex shaft housing 122, the stator housing 142 and/or the bottom sub 170 can be formed as integral housing units, with the top sub housing 14 being attachable thereto.

Figure 18:
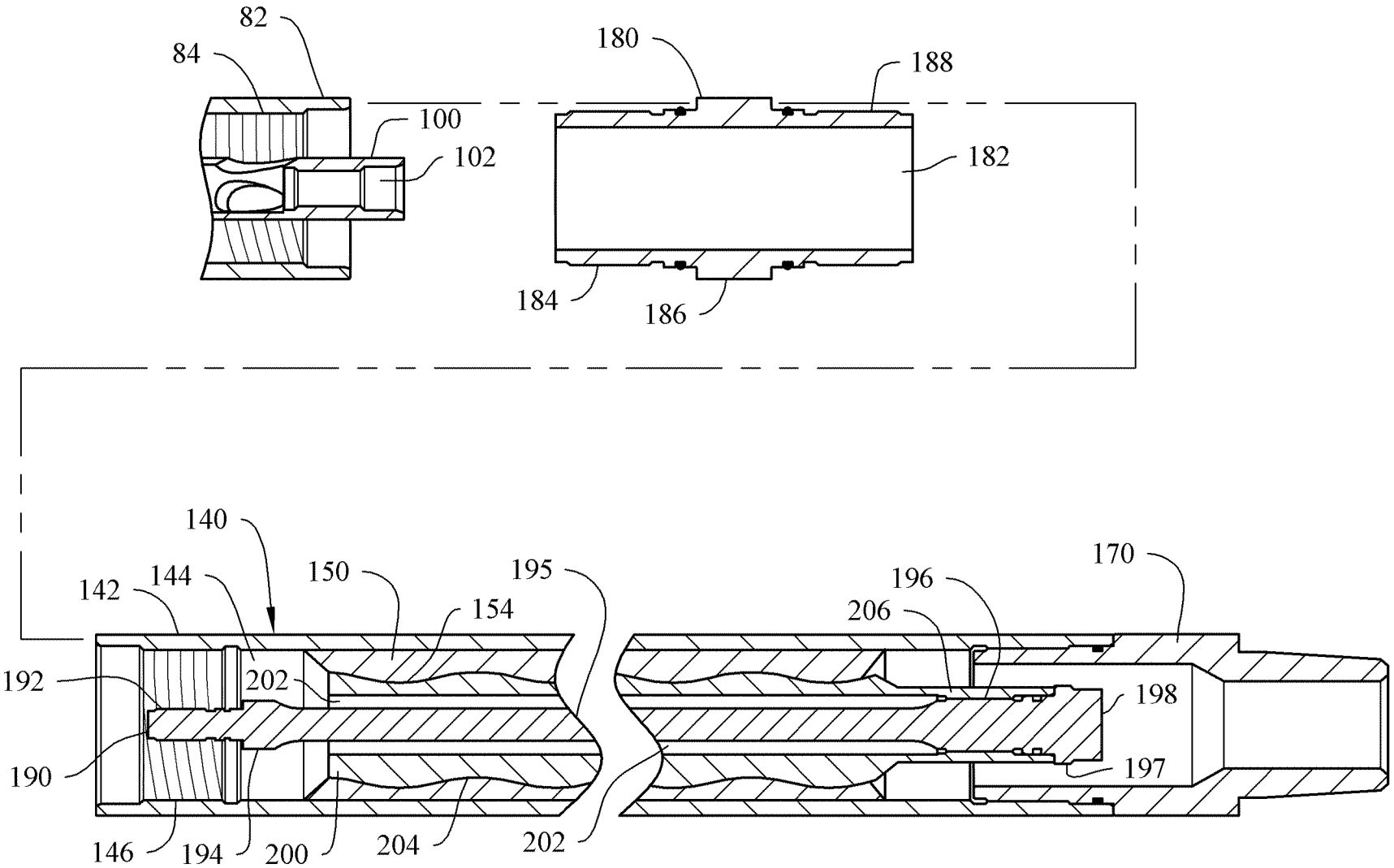
FIG. 18 is a cross-sectional view of an alternate embodiment rotor/stator assembly including an alternate flex shaft and rotor of the present technology.

Referring to FIG. 18, some embodiments of the present technology can include an alternate embodiment rotor/stator assembly 160 including an alternate flex shaft housing 180, flex shaft 190 and rotor 200. This alternate embodiment rotor/stator assembly 160 can reduce the size of the flex shaft housing, thereby consolidating the system and reducing weight. In some cases, the flex shaft housing can be eliminated.

The flex shaft housing 180 can be reduced essentially becoming a coupler including an axial coupler bore or cavity 182 defined therethrough, a first connection end 184, a main section 186, and a second connection end 188. The first connection end 184 can feature external threading capable of being engageable with the internal threading of the second connection end 86 of the bearing housing 82, thereby joining the bearing housing 82 and the flex shaft housing 180. It can be appreciated that seals can be utilized between the first connection end 184 of the flex shaft housing 180 and the second connection end 86 of the bearing housing 82.

The main section 186 can be configured to be engaged by a tool for installation, removal or manipulation of the flex shaft housing 180.

The second connection end 188 can feature external threading capable of being engageable with the internal threading of the first connection end 146 of the stator housing 142, thereby joining the stator housing 142 and the flex shaft housing 180. It can be appreciated that seals can be utilized between the second connection end 188 of the flex shaft housing 180 and the first connection end 146 of the stator housing 142.

The alternate flex shaft 190 can include a first connection end 192 featuring external threading, a shaft section 195, and a second connection end 198. The second connection end 198 or a portion adjacent thereto can include external threading 196, and a lip or flange 197 extending outward from an exterior the second connection end 198. It can be appreciated that the lip 197 can be a radial lip or at least one projection or tab. The lip 197 has a diameter or height sufficient to produce a stop edge.

The alternate rotor 200 includes an axial rotor bore or cavity 202 defined therethrough and configured to receive the first connection end 192 and the shaft section 195 of the flex shaft 190. The rotor 200 includes a first open end, and a second connection end 206 featuring internal threading capable of being engageable with the external threading 196 of the second connection end 198 of the flex shaft 190, thereby joining the flex shaft 190 and the rotor 200. It can be appreciated that seals can be utilized between the second connection end 198 of the flex shaft 190 and the second connection end 206 of the rotor 200. One or more helical or spiral lobes 204 are configured along a part of a longitudinal length of the rotor 200, with the lobes 154, 204 of the stator 150 and the rotor 200 being complimentary to or with each other.

When assembled, the lip 197 of the second connection end 198 can contact the second connection end 206 of the rotor 200. The lip 197 has a diameter or height sufficient to produce a stop edge that can contact or abut the second connection end 206 of the rotor 200 when assembled.

It can be appreciated that the flex shaft 190 can include exterior planar surfaces 194 that are engageable by a tool for installation, removal or manipulation of the flex shaft 190. The exterior planar surfaces 194 can be part of or adjacent with the first connection end 192 of the flex shaft and/or part of the second connection end 198.

In use, it can now be understood that pressurized fluid flowing through the progressing-cavity stator/rotor combination provides rotational power to turn the rotor relative to the stator. The stator is rigidly connected to the BHA, either directly or by way of the stator housing.

In general and in the exemplary, the downhole pulsation system 10 is assembled, with the valve sub housing 14 connected in series to the drill string 2, and the stator housing 142 or bottom sub 170 connected to the BHA 8. The drill string 2, downhole pulsation system 10 and the BHA 8 are introduced and advanced through the wellbore 6 for downhole operations. Working fluid is pumped through the drill string 2, which enters the valve sub assembly 12, through the mandrel cap 50 and then through the mandrel 90. The working fluid then travels through an annulus associated exterior of the flex shaft 130, and then enters the rotor/stator assembly 140. Upon which, nutation and rotation is imparted onto the rotor 160, which consequently rotates the mandrel cap 50. Rotation of the mandrel cap 50 thus rotates the ports 46, 62 in and out of obstruction with the lobe feature 34 or the lobed insert 30. This intermittent obstruction creates a pressure pulse within the system and consequently translates to mechanical vibration, pulsation or vibration of the drill string 2 and/or BHA 8.

Figure 19A:
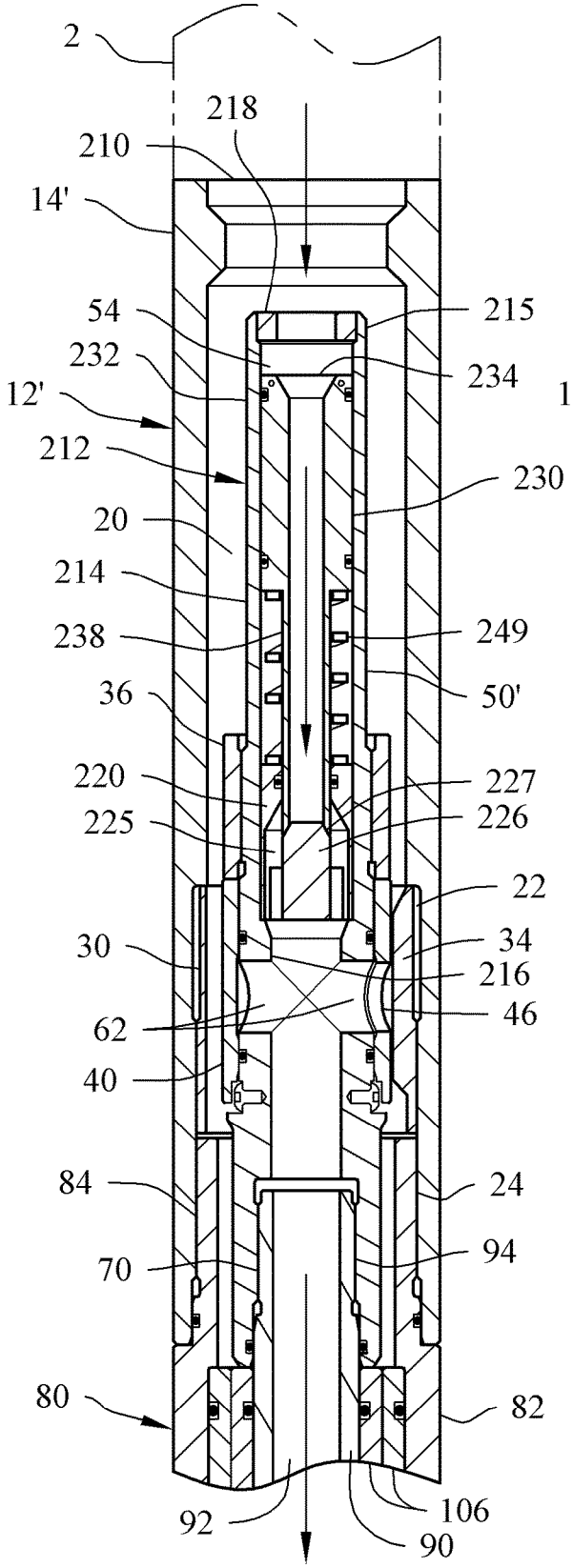
FIGS. 19A and 19B are cross-sectional views of the flow activated valve assembly in a valve closed position (FIG. 19A) and valve open position (FIG. 19B).
Figure 19B:
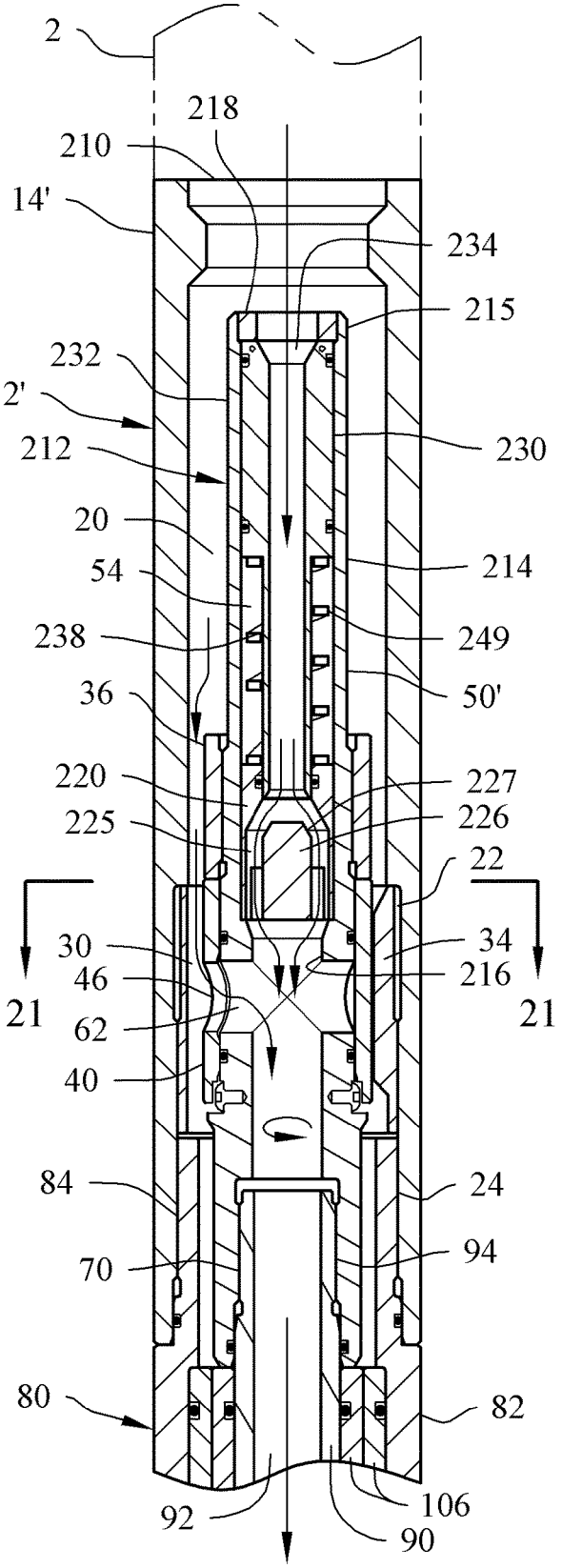

Referring to FIGS. 19A-21, some embodiments of the present technology can utilize a flow or object activated valve assembly 212 including an alternate mandrel cap 50', a mandrel cap valve insert 220, and a valve body 230 that axially moves inside an inlet section of the mandrel cap 50' to create a valve closed position (FIG. 19A) and a valve open position (FIG. 19B).

An alternate valve sub assemble 12' can be utilized with the valve assembly 212, but can it can be appreciated that the valve assembly 212 can be utilized with other tubulars, such as but not limited to the valve sub assembly illustrated in FIGS. 7A and 7B. The valve sub assembly 12' can include a top or valve sub housing 14', the lobed insert 30, the threaded collar 36, and the ported sleeve 40. The top sub housing 14' defines an axial bore or cavity therethrough, and includes a box connection 210, which can include internal threading or other connection means that is capable of engaging with a pin connection of the coiled tubing 2 or other downhole tool. The internal cavity of the top sub housing 14' includes a narrowing section 211 that transitions from the box connection 210, which reduces the diameter of the cavity. A main cavity section 20 then transitions from the narrowing section 211, and can have a diameter larger than an end of the narrowing section 211.

Figure 3:
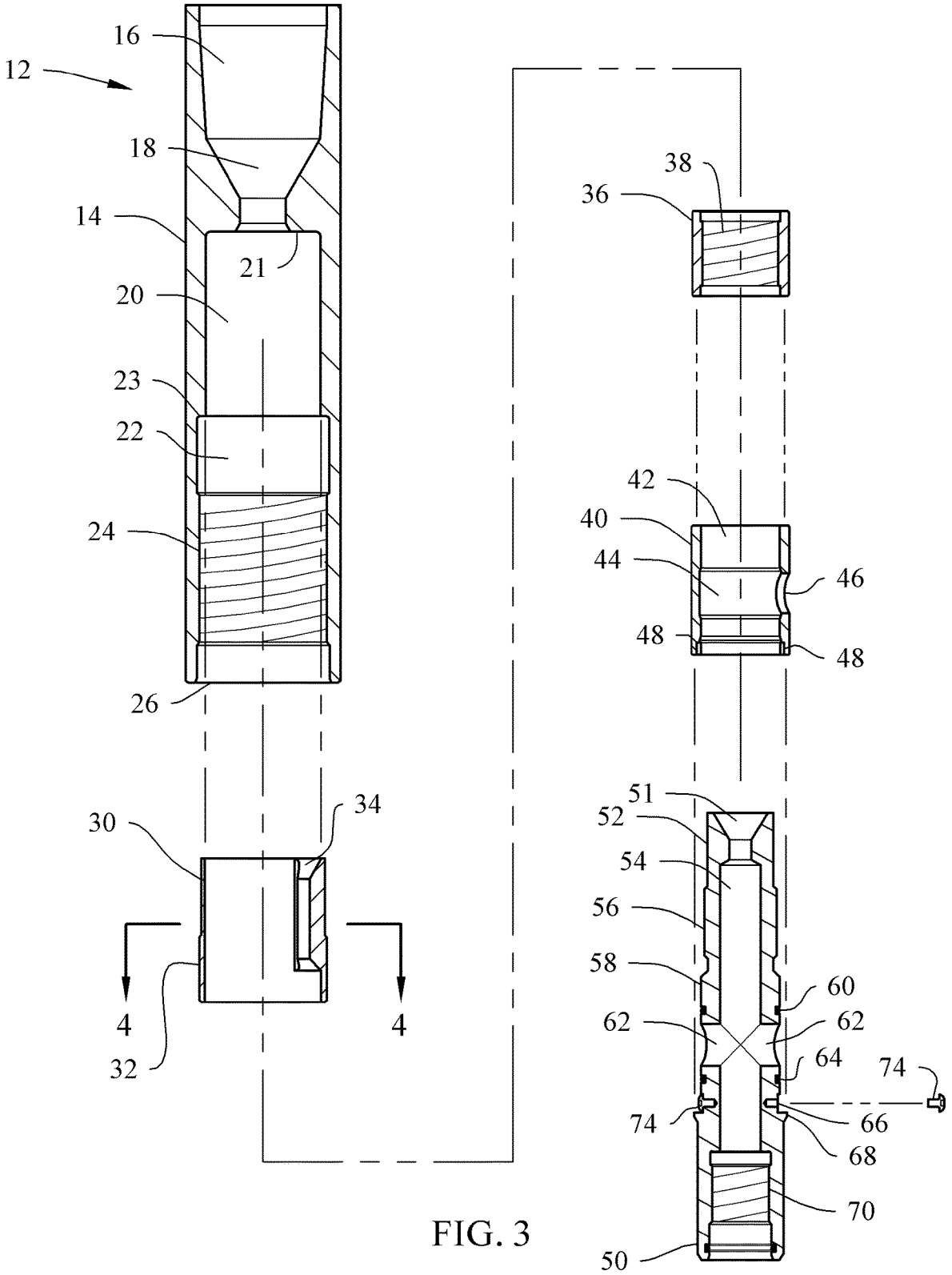
FIG. 3 is an exploded cross-sectional view of the valve sub assembly of the present technology.

As similar to other embodiments of the valve sub assembly of the present technology, as best illustrated in FIG. 3, a secondary cavity section 22 can transition from the main cavity section 20, and which has a diameter larger than the main cavity section 20, thereby creating a stop edge wall 23. Internal threading of a second connection end can be associated with a portion of the secondary cavity section 22. An open end can be adjacent the internal threading of the second connection end 2.

The lobed insert 30 is received in the second cavity section 22 and assembled therewith. The ported sleeve 40, as best illustrated in FIG. 5, defines an axial sleeve bore or cavity therethrough, and has a diameter allowing it to be received through the lobed insert 30.

Figure 20:
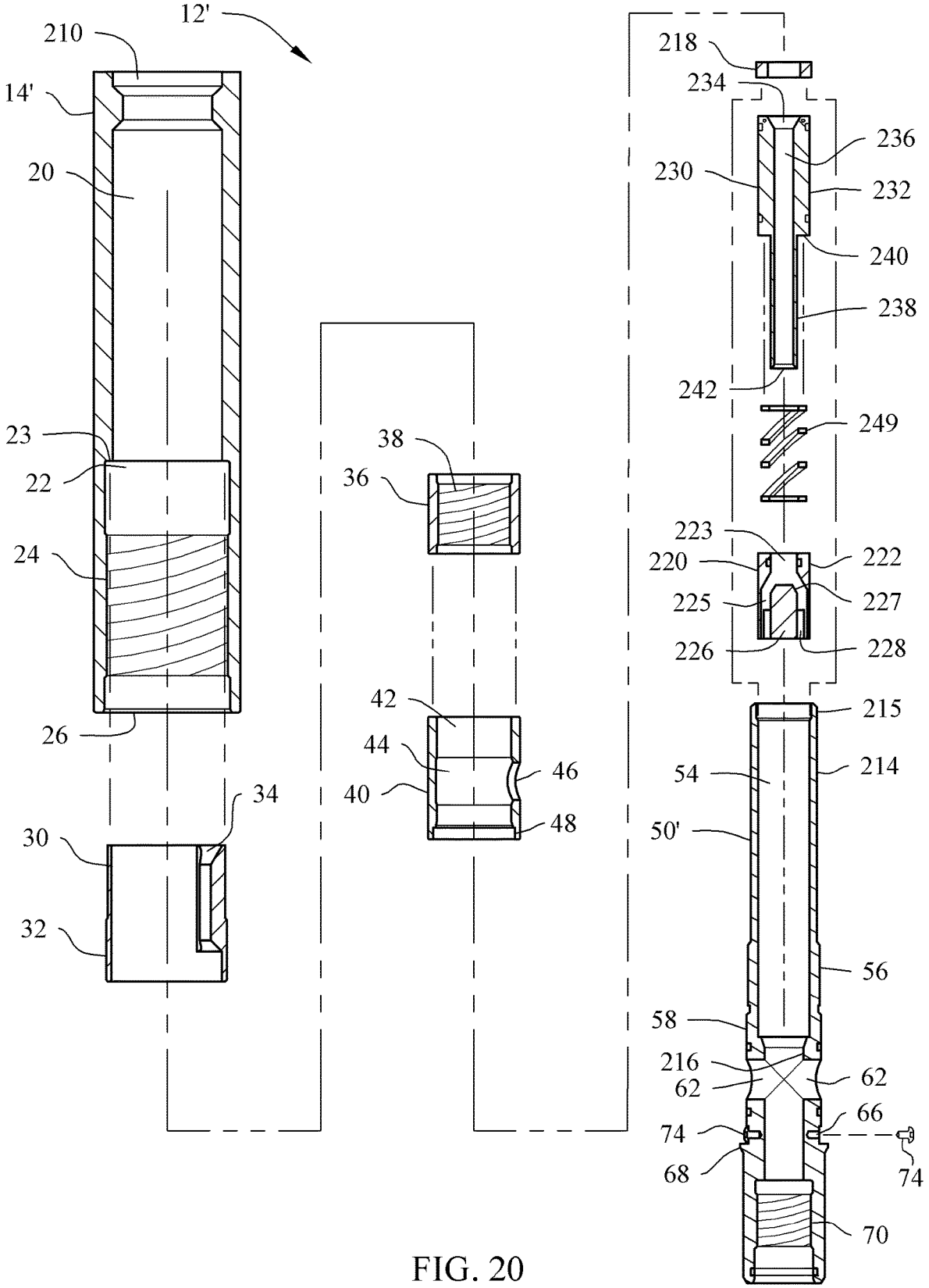
FIG. 20 is an exploded cross-sectional view of the flow activated valve assembly of the present technology.
Figure 21:
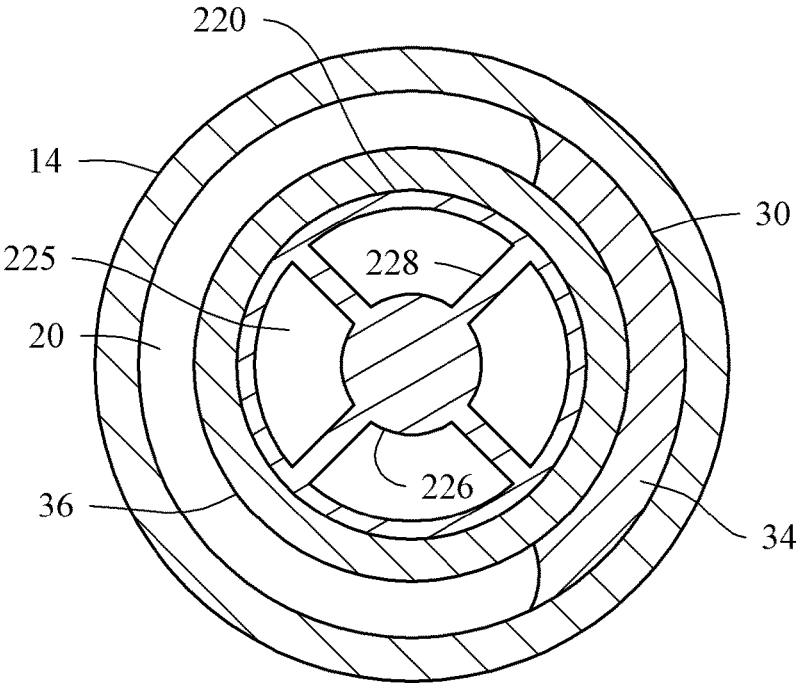
FIG. 21 is a cross-sectional view of the flow activated valve assembly taken along line 21-21 in FIG. 19B.
Figure 22:
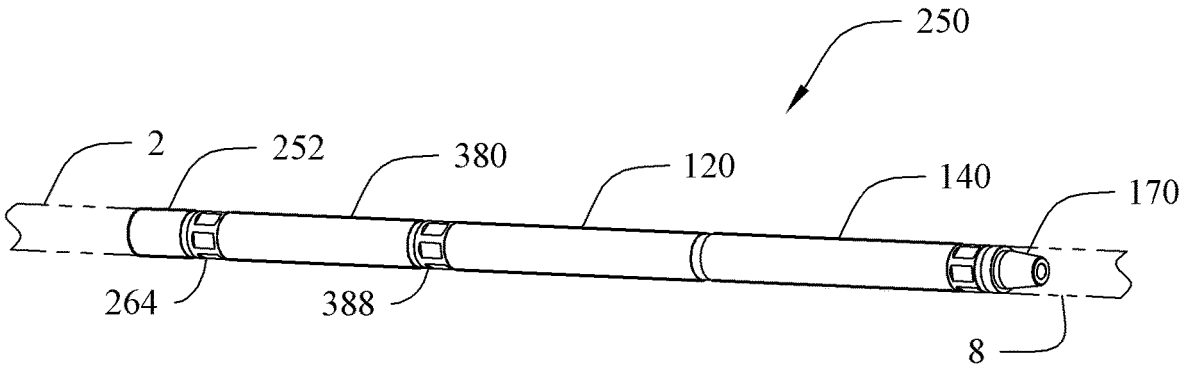
FIG. 22 is a perspective view of the dropped object activated valve assembly of the present technology.

As best illustrated in FIGS. 19A-20, the mandrel cap 50' defines an axial cap bore or cavity therethrough, and includes a first end section 214 that can feature exterior planar surfaces, and defining a retainer receiving end 215 that can be internally threaded. A retainer nut or ring 218 defines a bore therethrough, and is engageable with the retainer receiving end 215 of the first end section 214. The first end section 214 has a diameter allowing it to be received through the ported sleeve 40 and in the main cavity section 20 of the top sub housing 14', when assembled. The exterior planar surfaces of the mandrel cap 50' can be arranged to create a geometrical configuration capable of being engaged with a tool for installation, removal or manipulation of the mandrel cap 50'.

Adjacent to the first end section 214 is an external threading section 56 capable of engaging with internal threading of the collar 36.

The first end section 214 defines a main cap cavity 54 transitions from the retainer receiving end 215, and has a diameter less than the retainer receiving end.

Following the external threading section 56 is a port section 58, which includes one or more ports 62 that are defined through the sidewall of the port section 58, and are in communication with the cap cavity 54. It can be appreciated that any number, size and configuration of ports 62 can be utilized. The port section 58 can include an internal narrowing section 216 that creates an internal stop edge that can contact or abut an end of the valve insert 220 when assembled from the cap cavity 54.

The port section 58 can have a diameter the same or larger than the first end section 214 or the external threading section 56. The diameter of the port section 58 allows it to be slidably and rotatably received in the ported sleeve 40, so that the port 46 of the ported sleeve 40 is alignable with at least one of the ports 62. Seals can be utilized on the exterior of the port section 58 on either side of the ports 62 to provide fluid tight seal against an interior surface of the ported sleeve 40, when assembled.

The port section 58 can include threaded bores 66 defined therein, each configured to engage with and receive a fastener 74. The number and location of the bores 66 correspond with the number and location of the notches 48 of the ported sleeve 40. When the ported sleeve 40 is assembled with the mandrel cap 50, a head of each of the fasteners 74 is received in a corresponding notch 48, respectively. This can further prevent the ported sleeve 40 from rotating freely with respect to the mandrel cap 50. It can be appreciated that pins, detents, latches, and the like can be used in place of the fastener 74.

Adjacent to the bores 66 is a lip 68 extending outward from an exterior the mandrel cap 50. It can be appreciated that the lip 68 can be a radial lip or at least one projection or tab. The lip 68 has a diameter or height sufficient to produce a stop edge that can contact or abut the end of the ported sleeve 40 when assembled. The mandrel cap 50' includes a second connection end 70 featuring internal threading adjacent to an end thereof.

The valve insert 220 can include a first insert end section 222, and a second insert end section 224. The first insert end section 222 can define an internal bore 223 therethrough capable of slidable receiving a second valve end section 238 of the valve body 230. It can be appreciated that a seal can be utilized and associated with an internal side of the first insert end section 222 defining the internal bore 223 to provide a seal against the second valve end section 238 of the valve body 230.

The second insert end 224 can define a valve insert cavity 225 in communication with bore 223. The valve insert cavity 225 can have a diameter or size larger than that of the bore 223. A valve plug 226 can be provided in the valve insert cavity 225, and can include a tapered or conical sealing end 227 configured to make contact with a tapered or conical sealing end 242 of the second valve end section 238 of the valve body 230 when in a closed position (FIG. 19A). Support members or legs 228 can be utilized to position or support the valve plug 226 in the valve insert cavity 225. The valve insert cavity 225 is configured to allow fluid to pass therethrough and around the valve plug 226 when the valve body 230 is in the open position (FIG. 19B).

The valve body 230 can include a first valve end section 232, and a second valve end section 238, and can be configured to be axially slidable within the main cap cavity 54 of the mandrel cap 50'. The valve body 230 is prevented from sliding out of the main cap cavity 54 by the retainer ring 218, when assembled.

The first valve end section 232 can include a first valve end bore 234 defined through a free end of the first valve end section 232. The first valve end bore 234 is in fluid communication with the main cap cavity 54 in the valve closed position, and is in fluid communication with the through bore of the retainer ring 218 when in the valve closed position. The first valve end bore 234 can include a taper, conical or narrowing section. It can be appreciated that seals can be utilized and associated with an external side of the first valve end section 232 to provide a seal against an internal surface defining the main cap cavity 54 of the mandrel cap 50'.

The first valve end section 232 can further defined a valve body bore 236 extending longitudinally through the valve body 230. The valve body bore 236 is in communication with the first valve end bore 234, and can have a diameter or size less than the first valve end bore 234, thereby creating a narrowing or flow restricting section.

The second valve end section 238 transitions or extends from the first valve end section 232, and can have a diameter or size less than the first valve end section 232, thereby creating a stop ledge or lip 240. A free end of the second valve end section 238 defines the sealing end 242 that can include an internal tapered or conical sealing surface. This sealing surface of the sealing end 242 has a configuration corresponding with the tapered or conical sealing end 227 of the valve plug 226 so as to create a fluid flow seal when the these sealing surfaces contact each other, as best illustrated in FIG. 17A.

A biasing element or spring 249 can be utilized to provide a pushing force against the valve body 230 toward the retainer ring 218. The spring 249 can be configured to receive the second valve end section 238 therethrough, and contact the stop ledge 240 at a first spring end and contact the first insert end section 222 of the valve insert 220 at a second spring end.

The assembled valve assembly is best illustrated in FIGS. 19A-20, which includes the lobed insert 30 securely fitted to the internal threading of the second connection end 24 of the top sub housing 14' so that an end of the lobed insert 30 contacts or is adjacent to the stop edge 23.

The ported sleeve 40 is slidably positioned over the first valve end section 232 of the mandrel cap 50' and then onto the port section 58 so that the notches 48 receive the heads of the fasteners 74 and the port 46 of the ported sleeve 40 is aligned with at least one of the ports 62 of the mandrel cap 50. Then the collar 36 is slidably received over the first valve end section 232 and then securely fitted to the external threading section 56 of the first valve end section 232. The collar 36 can be rotatably engaged with the external threading section 56 to squeeze or clamp the ported sleeve 40 to the mandrel cap 50'.

The top sub housing 14' and lobed insert 30 can slidably receive the collar 36, ported sleeve 40 and mandrel cap 50' so that the port 46 of the ported sleeve 40 is aligned with the lobe feature 34 and rotatable within the lobed insert 30. The lobe feature 34 is configured and in sufficient radial proximity to the port 46, to significantly obstruct the passage of fluid into the port 46, as they pass by each other during rotation of the mandrel cap 50', as best illustrated in FIG. 19A. Accordingly, only allowing fluid to pass from the main cavity section 20 of the top sub housing 14' into and through the bore of the retainer ring 218 and then into the main cap cavity 54 of the mandrel cap 50'. Upon the fluid entering the main cap cavity 54, it will contact the narrowed section associated with the first valve end bore 234, consequently creating an pushing force against the valve body 230 and forcing the sealing surface of the second valve end section 238 toward the sealing end 227 of the valve plug 226. This axial motion further compresses the spring 249, creating a biasing force that urges the valve body 230 toward the retainer ring 218.

It can be appreciated that the dimension or configuration of the narrowed section associated with the first valve end bore 234 and/or the spring force of the spring 249 can be configured to result in desired movement of the valve body 230 in relation to the flow or pressure of fluid flowing the top sub housing 14'. Upon a desired or predetermined fluid flow or an object being dropped to contact the retainer ring 218 or the first valve end bore 234, the valve body 230 can axially move toward the valve plug 226 so that a fluid seal is created between the second valve end section 238 and the sealing end 227, placing the valve body 230 is a closed position as best illustrated in FIG. 19A.

During rotation of the mandrel cap 50', the port 46 will cyclically pass by the lobe feature 34, consequently created cyclic obstruction and non-obstruction of the port 46. During non-obstruction of the port 46 by the lobe feature 34, as best illustrated in FIG. 19B, fluid can freely pass from the main cavity section 20 (annulus between the mandrel cap 50' and the top sub housing 14') of the top sub housing 14' into the port 46 of the ported sleeve 40 and through the port 62 of the mandrel cap 50', and then into the main cap cavity 54 of the mandrel cap 50'.

When the fluid flow drops below a predetermined value or the object is no longer obstructing the fluid flow, the spring 249 would urge the valve body 230 towards the retainer ring 218, thereby move the second valve end section 238 away from the sealing end 227 and consequently opening fluid communication between the main cap cavity 54 and the valve insert cavity 225, placing the valve body 230 is an open position as best illustrated in FIG. 19B. In this open position, some of the fluid flow entering the main cavity section 20 can travel through the main cap cavity 54, through the valve insert cavity 225 and then into the mandrel bore 92. It can be appreciated that the during rotation of the lobe insert 30, when the port 46 is not obstructed by the lobe feature 34 and when the valve body 230 is in the open position, the fluid flow from valve insert cavity 225 can merge with the other partial fluid flow entering from the port 46 and the port 62.

The valve assembly 212 and alternate valve sub assemble 12' can be utilized with any bearing housing assembly, flex shaft housing assembly, rotor/stator assembly and bottom sub of the present technology.

The valve assembly 212 can be activated by the differential pressure acting across the valve. The valve body can be a simple spring force where the valve body is held open until a threshold flow rate is achieve and the valve body begins to close, as it closes, the pulsations created by the stator/rotor will increase. When the valve body is fully closed, the pulsations will be at their maximum.

Alternatively, the valve body can be a snap acting valve where the valve body fully closes as soon as the threshold flow rate is achieved.

Alternatively, the valve body can be controlled by a J-Slot pattern so that a user can choose to have the valve body in open or closed positions. To change function, the user can reduce or stop pumping allowing the valve body to shift positions utilizing the J-Slot.

The valve assembly 212 is depicted as an axial moving valve that opens and closes to control the amount of flow that bypasses the rotating pulsation valve, including the lobed insert, the ported sleeve, the mandrel cap and all other components to rotate them. A similar function can be achieved in numerous ways such as having the valve assembly 212 move the radial ports in and out of the lobbed section.

Alternatively, the lobed insert could be moved in and out of alignment with the radial holes.

Referring to FIGS. 22-31, embodiments of the present technology can utilize an actuatable valve system 250 including a valve sub assembly 252, a bearing housing 380, a flex shaft housing assembly 120, a rotor/stator assembly 140 and a bottom sub 170. The valve system 250, when assembled, can have a smooth outer surface with a diameter less than the wellbore, so it can easily be conveyed through the wellhead system and wellbore.

The valve system 250 can be utilized in place of any valve system of the present technology, but it can be appreciated that the valve system 250 can be utilized with other tubulars, such as but not limited to the valve sub assembly illustrated herewith.

Referring to FIGS. 23-27, the valve sub assembly 252 includes a valve or top sub housing 254, a bearing 272, a seat retainer 274, a seat unit 300, a threaded collar 320, a ported sleeve 330, a mandrel cap 340, a lobed insert 370, and a compression ring 378. The top sub housing 254 defines an axial bore or cavity therethrough, and includes a box connection 256 with internal threading that is capable of engaging with a pin connection of the coiled tubing 2 or other downhole tool. The internal cavity includes a narrowing section that transitions from the box connection 256, which reduces the diameter of the cavity. A main cavity section 260 then transitions from the narrowing section, and has a diameter larger than an end of the narrowing section, thereby creating a stop edge wall 262.

The top sub housing 254 can include exterior planar surfaces 264 arranged to create a geometrical configuration capable of being engaged with a tool for installation, removal or manipulation of the top sub housing 254. A stop ledge 266 can extend from the exterior of the top sub housing 254 that is capable of abutting against the bearing housing 380 when assembled. An open end section 270 can be adjacent the stop ledge 266 and can include external threading engageable with internal threading 384 associated with an end of the bearing housing 380. A seal can be utilized between the exterior of the open end section 270 and an internal surface of the bearing housing 380.

A bearing 272 can be receivable in the main cavity section 260 to abut against the stop edge wall 262. The bearing 272 can be any suitable bearing, such as but not limited to, a ball bearing, a sleeve or a bushing.

Figure 24:
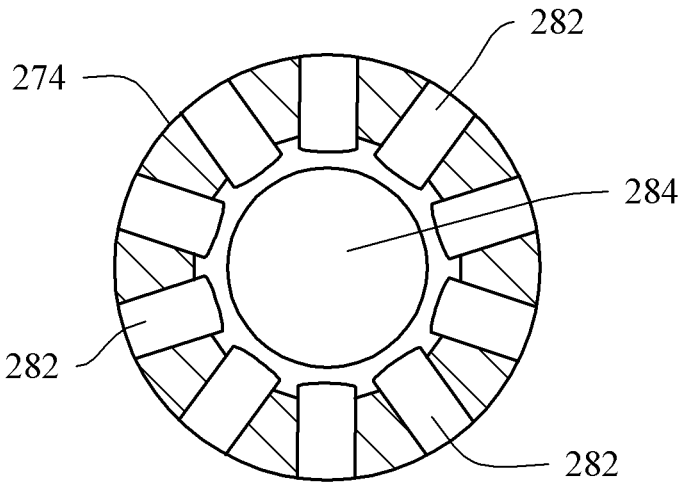
FIG. 24 is a cross-sectional view of the seat retainer taken along line 24-24 in FIG. 23.

The seat retainer 274 can include a first end section 276 that can be configured to be receivable through an opening in the bearing 272 and optionally through the narrowing section or the box connection 256 of the top sub housing 254. A stop ledge 280 can extend from the exterior of the first end section 276 that is capable of abutting against the bearing 272 when assembled. The first end section 276 can include an internal cavity 278 defined therethrough. The cavity 278 can have a conical configuration. A plurality of radially arranged ports 282 can be defined laterally through the first end section 276 in communication with the cavity 278, as best illustrated in FIG. 24. The stop ledge 280 can be located between the open end of the first end section 276 and the ports 282, thereby positioning the ports 282 in the main cavity section 260 of the top sub housing 254 when assembled.

The seat retainer 274 can further include a second end section 288 including a bore 284 defined therethrough and in communication with the cavity 278. The second end section 288 can include a stop ledge 286 and can include external threading engageable with internal threading 346 associated with a first cavity section 344 of the mandrel cap 340. A seal can be utilized between the exterior of the second end section 288 and an internal surface defining the first cavity section 344.

The seat unit 300 can include a first end and cavity section 302 that can be configured to abut against the second end section 288 of the seat retainer 274 when assembled.

A third cavity section 306 can transition from the second cavity section 304, and can have a width or diameter less than the second cavity section 304 to produce a radial seat surface 307.

Figure 25:
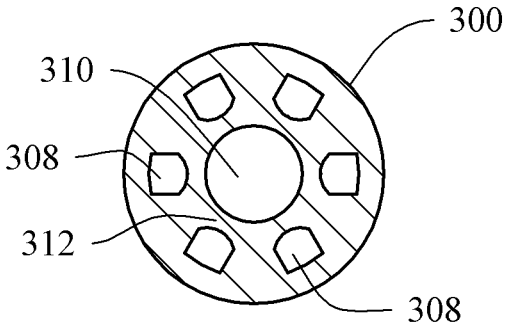
FIG. 25 is a cross-sectional view of the seat unit taken along line 25-25 in FIG. 23.

A second end section of the seat unit 300 can include an outer or fourth cavity section 308 transitioning from the third cavity section 306. The fourth cavity section 308 can have a width or diameter greater than the third cavity section 306. A central bore 310 is defined concentrically in the fourth cavity section 308 by a ring wall 309, and is in communication with the fourth cavity section 308 and/or the third cavity section 306. A plurality of radially arranged ports 312 can be defined through the ring wall 309 to define a passage between the third and fourth cavity sections 306, 308, as best illustrated in FIG. 25.

A ported sleeve 330 defines an axial sleeve bore or cavity 332 therethrough, and has a diameter allowing it to be received through the lobed insert 370. The ported sleeve 330 defines a port cavity section 334 in communication with the cavity 332, and at least one slot or port 336 defined through the sidewall of the sleeve 330 and in communication with the port cavity section 334. It can be appreciated that the ported sleeve 330 can include multiple ports 336, each with the same or varying sized openings. The cavity 332 and the port cavity section 334 are configured to receive a section of the mandrel cap 340 therethrough when assembled.

The port cavity section 334 can have a diameter larger than the cavity 332. One or more sleeve notches 338 can be defined in an internal surface of the sidewall adjacent an open end of the sleeve 330. The notches 338 can be in communication with the cavity 332 or port cavity section 334 and exterior of the sleeve 330. The notches 338 can be configured to receive at least a portion of a dowel or pin 339, which is configured to prevent rotation of the sleeve 330 about the mandrel cap 340 when assembled.

A retainer collar 320 can be utilized to secure the sleeve 330 to the mandrel cap 340, and can be configured to be receivable in the main cavity section 260 of the top sub housing 254. The collar 320 can include a cavity 322 defined therethrough, which can include at least one internal threaded section. The cavity 322 can be configured to receive at least a portion of the mandrel cap 340 therethrough, and not the ported sleeve 330 by an abutment arrangement between an end of the collar 320 and an end of the ported sleeve 330. The internal threading of the cavity 322 is engageable with an external threading section 348 of the mandrel cap 340. The exterior of the collar 320 can include exterior planar surfaces 324 arranged to create a geometrical configuration capable of being engaged with a tool for installation, removal or manipulation of the collar 320.

The mandrel cap 340 defines an axial cap bore or cavity therethrough, and includes a first end section 342 featuring exterior planar surfaces, and defining a first cavity section 344. The first end section 342 has a diameter allowing it to be received through the ported sleeve 330. The exterior planar surfaces can be arranged to create a geometrical configuration capable of being engaged with a tool for installation, removal or manipulation of the mandrel cap 340.

The first cavity section 344 is configured to receive the second end section 288 of the seat retainer 274 therein, and can include internal threading 346 engageable with the external threading of the second end section 288 of the seat retainer 274 to assemble them together.

Adjacent to the first end section 342 is an external threading section 348 capable of engaging with internal threading of the cavity 322 of the collar 320.

A second cavity section 350 can be defined in the mandrel cap 340 that is in communication with the first cavity section 344. The second cavity section 350 can have a width or diameter less than the first cavity section 344.

The second cavity section 350 then transitions to a cap cavity section 354 by way of a narrowing cavity section that has a diameter less than the second and cap cavity sections 350, 354, thereby creating a stop edge wall 352.

The cap cavity section 354 transitions from the narrowing cavity section 352, and has a width or diameter larger than an end of the narrowing cavity section 352.

Following the external threading section 348 is a port section 355, which includes one or more slots or ports 356 that are defined through the sidewall of the port section 355, and are in communication with the cap cavity section 354. It can be appreciated that any number, size and configuration of cap ports 356 can be utilized. The port section 355 can have a width or diameter the same or larger than the first end section 342 or the external threading section 348. The width or diameter of the port section allows it to be slidably and rotatably received in the ported sleeve 330, so that the port 336 of the ported sleeve 330 is alignable with at least one of the cap ports 356. Seals can be utilized on the exterior of the port section 355 on either side of the cap ports 356 to provide fluid tight seal against an interior surface of the ported sleeve 330, when assembled.

The port section 355 can include one or more cap notches 358 defined therein, and configured to engage with and receive at least a portion of the pin 339. The number and location of the notches 358 correspond with the number and location of the notches 338 of the ported sleeve 330. When the ported sleeve 330 is assembled with the mandrel cap 340, portions of the pin 339 is received in corresponding notches 338, 358, respectively. This can further prevent the ported sleeve 330 from rotating freely with respect to the mandrel cap 340. It can be appreciated that fasteners, detents, latches, locks and the like can be used in place of the pin 339.

Adjacent to the notch 358 is a lip extending outward from an exterior the mandrel cap 340. It can be appreciated that the lip can be a radial lip or at least one projection or tab. The lip has a width, diameter or height sufficient to produce a stop edge that can contact or abut the end of the ported sleeve 330 when assembled. The mandrel cap 340 includes a second connection end section 362 defining an internal cavity 360 featuring internal threading adjacent to an end thereof.

A lobed insert 370 includes an externally threaded first end section 372, and an axial bore or cavity 376 defined therethrough. The externally threading 372 is configured to be engageable with an external threading of the open end section 270 of the top sub housing 254 when assembled. The lobed insert 370 can have a width or diameter allowing it to be received in a first cavity section 382 of the bearing housing 380, and the cavity 376 can have a width or diameter configured to receive therethrough the collar 320, the ported sleeve 330 and/or the mandrel cap 340.

Extending into the cavity 376 of the lobed insert 370 is at least one lobe feature 374 that projects from an internal surface of the lobed insert 370. When assembled, an end of the lobed insert 370 can contact or abut an end of a compression ring 378 received in the first cavity section 382 of the bearing housing 380, thereby securing the lobed insert 370 in place and preventing it from being rotated. The lobed insert 370 can include interior notches or surfaces that are capable of receiving a tool end for assistance in removal and/or installation of the lobed insert 370 within the bearing housing 380. It can be appreciated that the lobed insert 370 can include multiple lobe features 374, each with the same or varying thickness or heights, and with the same or varying surface configurations.

Figure 23:
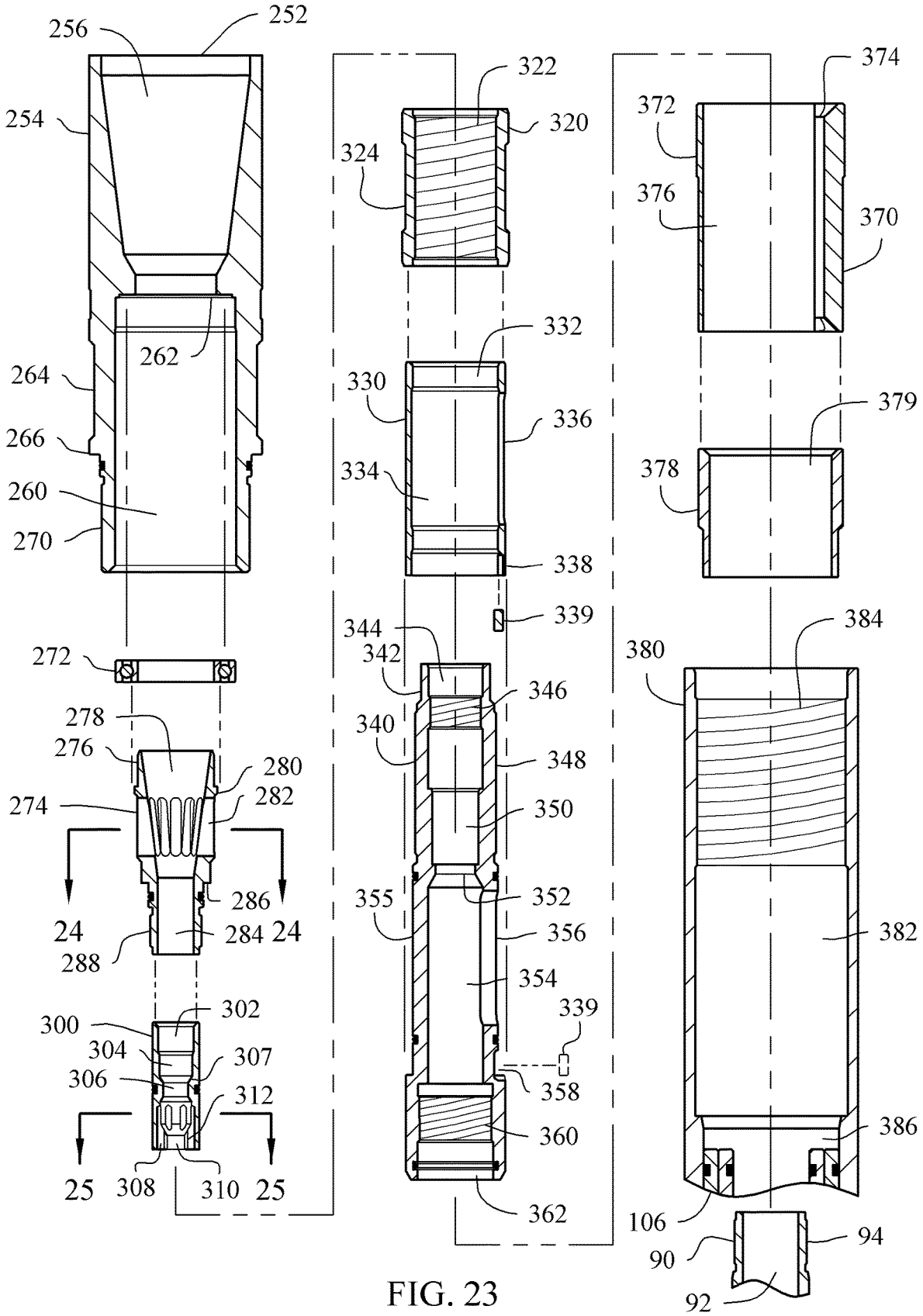
FIG. 23 is an exploded cross-sectional view of the dropped object activated valve assembly of the present technology.
Figure 26:
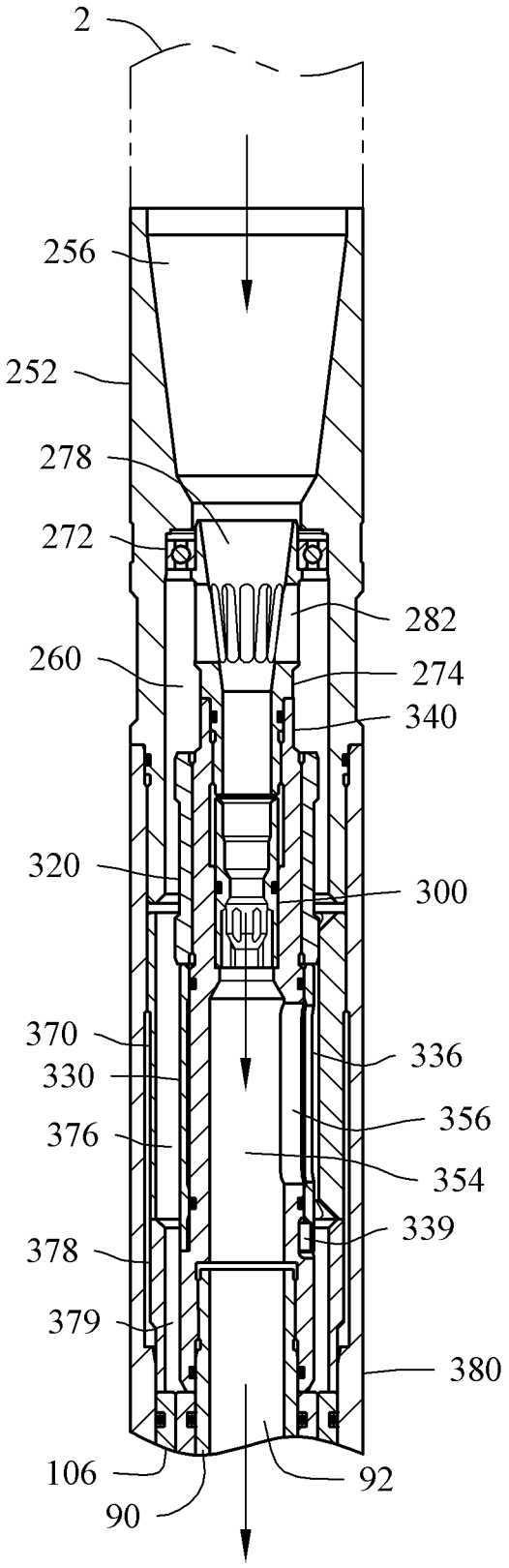
FIGS. 26 and 27 are cross-sectional views of a fully open dropped object activated valve assembly in a valve closed position (FIG. 26) and valve open position (FIG. 27).
Figure 27:
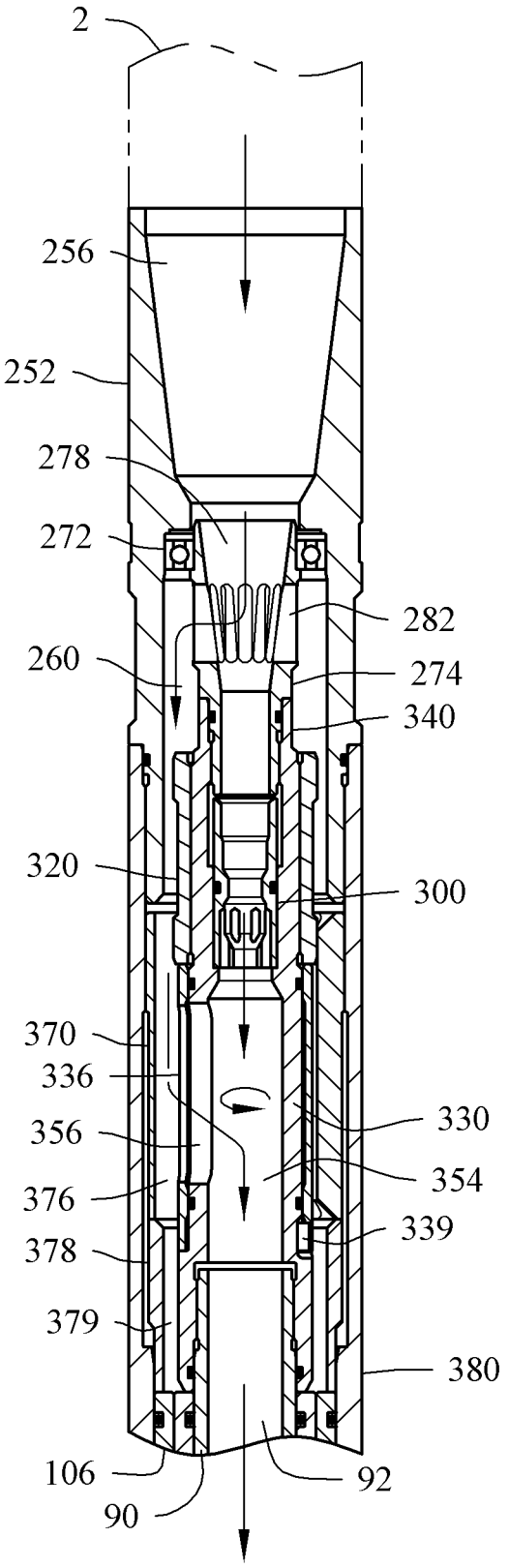

The assembled valve assembly is best illustrated in FIGS. 26 and 27, which includes the lobed insert 370 securely fitted to the internal threading of the first cavity section 382 of the bearing housing 380 so that an end of the lobed insert 370 contacts or abuts an end of the compression ring 378. The compression ring 378 defines an axial bore 379 therethrough, and when received in the first cavity section 382 of the bearing housing 380, contacts or abuts a stop ledge created between the first cavity section 382 and a second cavity section 386 of the bearing housing 380, as best illustrated in FIG. 23.

In the exemplary, the seat unit 300 is assembled with the mandrel cap by inserting through the first cavity section 344 and into the second cavity section 350 until an end of the seat unit 300 featuring the fourth cavity section 308 and central bore 310 is adjacent, contacts or abuts the stop edge wall 352.

The seat retainer 274 can be assembled with the mandrel cap by inserting the second end section 288 of the seat retainer 274 through the first cavity section 344 and into the second cavity section 350 until the second end section 288 is adjacent, contacts or abuts the first end section 302 of the seat unit 300. The external threading of the second end section 288 of the seat retainer 274 can be rotatably engaged with the internal threading 346 of the mandrel cap 340 to squeeze or clamp the seat unit 300 to the mandrel cap 340. When assembled, the first end section 276 is exposed from and exterior of the first end section 342 of the mandrel cap 340. The stop ledge 286 of the seat retainer 274 can be configured to contact the first end section 342 of the mandrel cap 340 when assembled, and to prevent overtightening.

The ported sleeve 330 can be slidably positioned over the first end section 342 of the mandrel cap 340 and then onto the port section 355 so that the notches 338, 358 receive the pin 339, and the port 336 of the ported sleeve 330 is aligned with at least one of the cap ports 356 of the mandrel cap 340. Then the collar 320 is slidably received over the first end section 342 and then securely fitted to the external threading section 348 of the first end section 342. The collar 320 can be rotatably engaged with the external threading section of the first end section 342 to squeeze or clamp the ported sleeve 330 to the mandrel cap 340.

The compression ring 378 can be received through the first cavity section 382 of the bearing housing 380 until it is adjacent, contact or abuts the stop edge associated with the second cavity section 386. The lobed insert 370 can be received through the first cavity section 382 of the bearing housing 380 and rotatably engaged with the internal threading section 384 to squeeze or clamp the compression ring 378 to the bearing housing 380.

The mandrel cap 340 can be received through axial cavity 376 of the lobed insert 370, the axial bore 379 of the compression ring 378, and the first cavity section 382 of the bearing housing 380 to be assembled with the mandrel 90. The internal threading 360 of the second connection end section 362 of the mandrel cap 340 can be assembled with external threading of the first connection end 94 of the mandrel 90.

After which, the bearing 272 can be placed over the first end section 276 of the seat retainer 274 until it is adjacent, contacts or abuts the stop ledge 280. Then the top sub housing 254 can be assembled with the bearing housing 380 so that the external threading of the open end section 270 is rotatably engaged with the internal threading section 384 to squeeze or clamp the bearing 272 between the stop edge wall 262 and the stop ledge 280.

When assembled, the ported sleeve 330 and mandrel cap 340 can be arranged so that the port 336 of the ported sleeve 330 is aligned with the lobe feature 374 and rotatable within the lobed insert 370. The lobe feature 374 can be configured and in sufficient radial proximity to the port 336, to significantly obstruct the passage of fluid through the port 336, as they pass by each other during rotation of the mandrel cap 340, as best illustrated in FIGS. 26 and 27. Accordingly, only allowing fluid to pass from the box connection 256 or the internal cavity 278 of the seat retainer 274 into the cavity section 302 of the seat unit 300, as best illustrated in FIG. 26. The lobe feature 374 can have a cylindrical surface that is oriented concentrically with respect to a rotation axis of the mandrel cap 340. The port 336 resides on a cylindrical surface that is oriented concentrically with respect to this rotation axis.

During rotation of the mandrel cap 340, the port 336 will cyclically pass by the lobe feature 374, consequently created cyclic obstruction and non-obstruction of the port 336. During non-obstruction of the port 336 by the lobe feature 374, as best illustrated in FIG. 27, fluid can freely pass from the main cavity section 260 (annulus between the mandrel cap 340 and the top sub housing 254) of the top sub housing 254 into the port 336 of the ported sleeve 330 and through the port 356 of the mandrel cap 340, and then into the cap cavity section 354 of the mandrel cap 340.

Figure 28A:
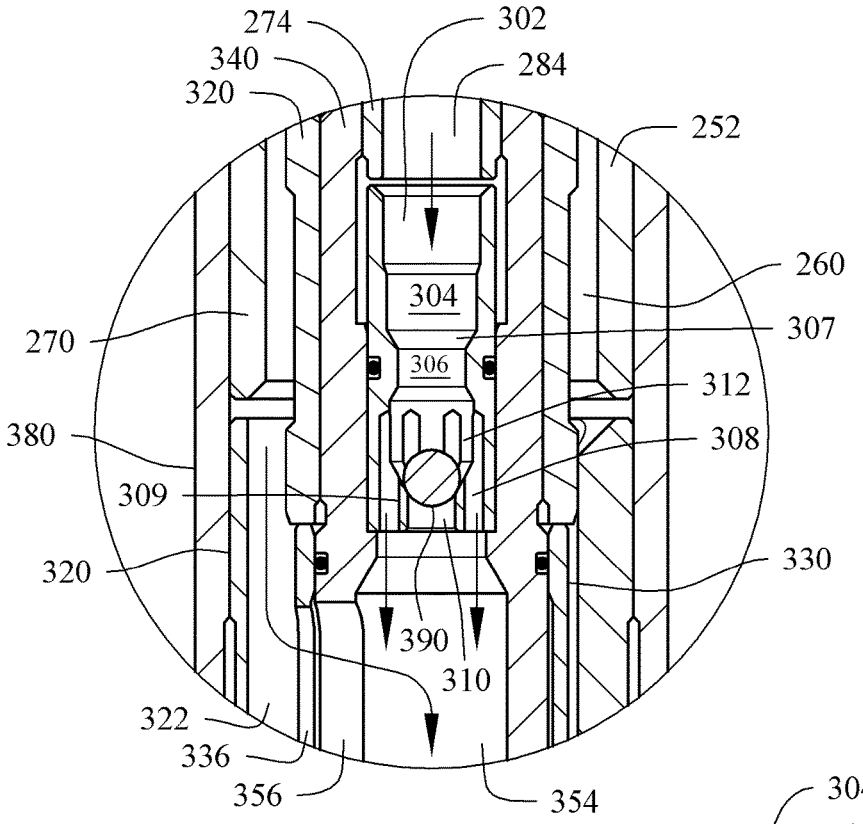
FIG. 28A is an enlarged cross-sectional view of the dropped object activated valve assembly in a partial bypass configuration utilizing a single dropped ball.
Figure 28B:
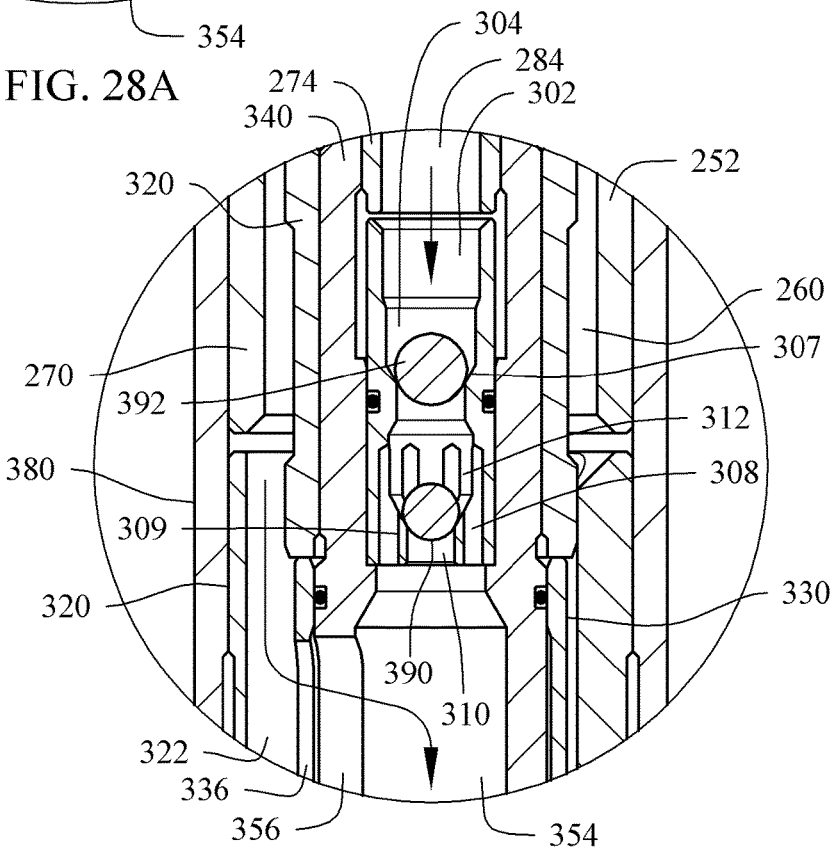
FIG. 28*b* is an enlarged cross-sectional view of the dropped object activated valve assembly in a no-bypass configuration utilizing two dropped balls.
Figure 29:
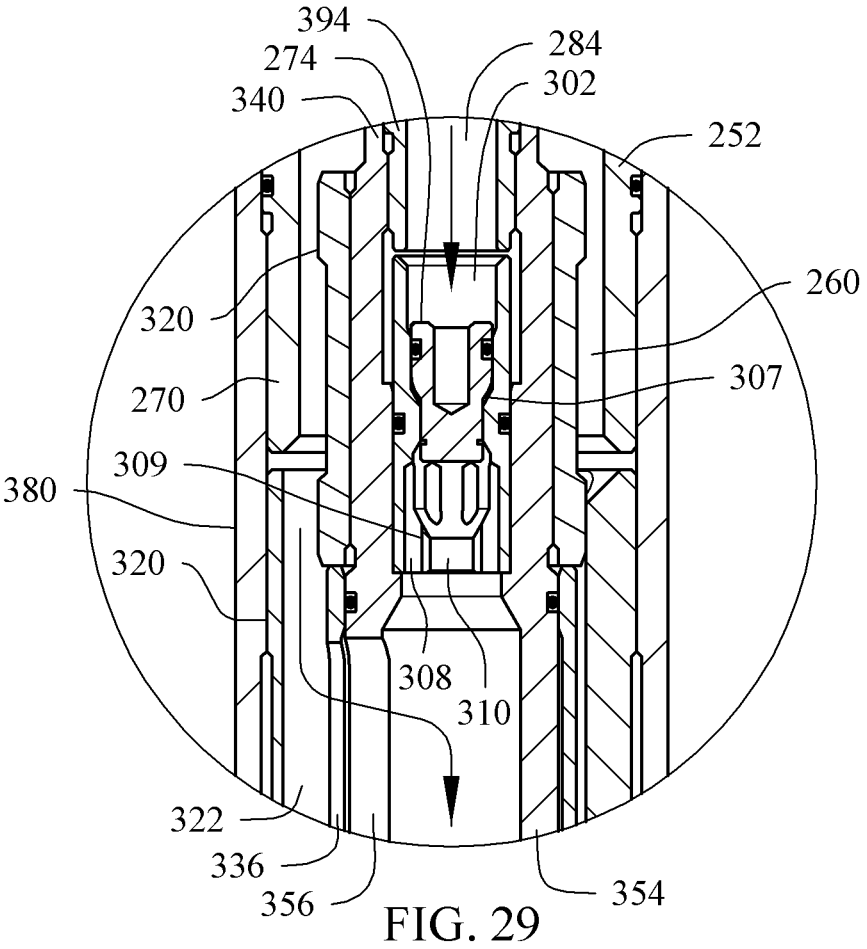
FIG. 29 is an enlarged cross-sectional view of the dropped object activated valve assembly in a no-bypass configuration utilizing a dropped plug.

Referring to FIGS. 28A, 28B and 29, embodiments of the actuatable valve system 250 of the present technology can utilize a fluid flow or a dropped object, such as but not limited to, a one or more dropped object or ball arrangement 390, 392, or a plug 394, to control fluid flow to the rotor/stator assembly or BHA. The lack of utilization of a dropped object such the balls 390, 392 and/or the plug 394 associated with the seat unit 300 creates a full by-pass configuration, where fluid is free to pass through the seat unit 300 and into the cap cavity section 354 of the mandrel cap 340, shown in FIGS. 26 and 27.

In the exemplary, the dual dropped object arrangement can include a first ball 390 having a width or diameter configured to contact and seal against a seat surface of the ring wall 309 of the seat unit 300, consequently producing a partial by-pass configuration, as best illustrated in FIG. 28A. The first ball 390 can be dropped and activates via the provision of the seat surface of the ring wall 309 defined by the narrowing cavity section of the seat unit 300.

When the first ball 390 is seated against the seat surface of the ring wall 309, fluid is obstructed from flowing into the central bore 310 of the seat unit 300. This creates a flow restriction and diverts at least a portion of the flow through the ports 312 and into the fourth cavity section 308, and subsequently into the cap cavity section 354 of the mandrel cap 340. In this partial by-pass configuration, a further portion of the fluid travels through the ports 282 and into the main cavity section 260 of the top sub housing 254.

A second ball 392 can be utilized to produce a no by-pass configuration, as best illustrated in FIG. 28B. The second ball 392 can include a width or diameter larger than the first ball 390, and configured to contact and seal against the seat surface 307 of the seat unit 300.

The second ball 392 can be dropped and activates via the provision of the seat surface 307 defined by the narrowing cavity section of the first end and cavity section 302 and the third cavity section 306, located upstream of the ring wall 309. When the second ball 392 is seated against the seat surface 307, fluid is completely obstructed from flowing into the third cavity section 306 and thus into the fourth cavity section 308 and the central bore 310. This no by-pass configuration stops all flow from entering into the cap cavity section 354 of the mandrel cap 340 from the seat unit 300, consequently forcing all fluid flow to travel through the ports 282 and into the main cavity section 260 (annulus between the mandrel cap 340 and the top sub housing 254) of the top sub housing 254 and the cavity 322 (annulus between the ported sleeve 330 and the collar 320) of the collar 320.

Figure 30:
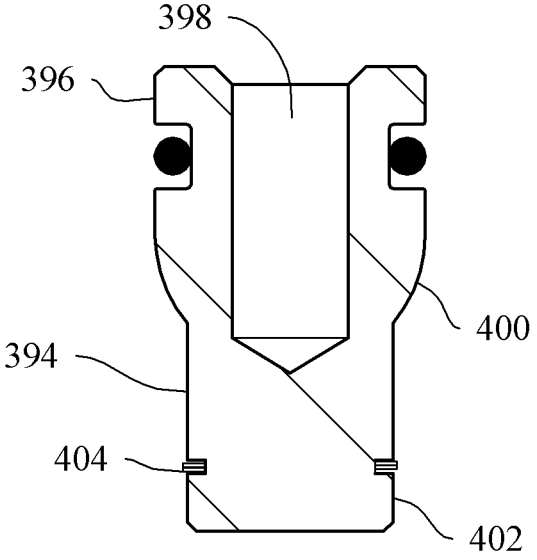
FIG. 30 is an enlarged cross-sectional view of the plug.

Some embodiments of the present technology can utilize a plug 394 to create the no by-pass configuration and/or the partial by-pass configuration, as best illustrate in FIGS. 29 and 30. The plug 394 can include a first end 396 featuring a space 398 defined therein, a transitioning section 400, and a second end 402. The first end 396 can have a width or diameter configured to be received in, contact and/or seal against an internal surface that defines the second cavity section 304 of the seat unit 300.

The second end 402 can have a width or diameter less than the first end 396, and can be configured to be received in the third cavity section 306 of the seat unit 300. The transitioning section 400 can be a planar or arcuate section that transitions between the first and second ends 396, 402. The transitioning section 400 can further be configured to contact and/or seal against the seat surface 307 of the seat unit 300.

A retainer ring 404 can be utilized with the second end 402 to seal against the internal surface that defines the second cavity section 304 and/or retain the plug 394 in the seat unit 300 when fully received therein.

It can be appreciated that the plug 394 can be dropped in a manner similar to the ball 390, 392 then received in the seat unit 300 to completely block fluid from flowing through the fourth cavity section 308 and the central bore 310, consequently creating the no by-pass configuration. It can further be appreciated that the plug 394 can be configured or include passages to create a partial by-pass configuration.

The utilization of a dropped object, such as but not limited to the ball 11, 390, 392 or plug 394, can provide an Inactive mode in the absence of a dropped object and an Active mode in the presence of the dropped object. In the Inactive mode, the PMA's TFA remains relatively large, even as the port(s) is obstructed. As such, the pressure spike amplitude generated by obstruction of the port(s) is attenuated. In the Active mode, once the ball is seated against the ball seat, the fluid pathway is closed thereby ceasing the attenuation.

The object can be dropped or pumped through the wellbore tubulars or coiled tubing 2 to activate a downhole tool or device. The dropped object can be, but not limited to, a hard non-dissolvable object, a deformable object, a dissolvable object or a destroyable object. Utilizing a deformable, a dissolvable or a destroyable object can allow for controlled operation of rotating the mandrel cap and mandrel, by obstructing a partial, majority or completely of the fluid flow through the axial cavity of the mandrel cap and mandrel and thus through the stator and rotor assembly. When agitation is required, pressure could be increased to deform the object through a narrowing cavity section associated with of the seat retainer 274, seat unit 300 and/or mandrel cap 50, 340 allowing the object to travel until contact is made with the first connection end of the flex shaft. Alternatively, the object can be made of a dissolvable material that is configured to dissolve by the fluid after a predetermined time.

Figure 31:
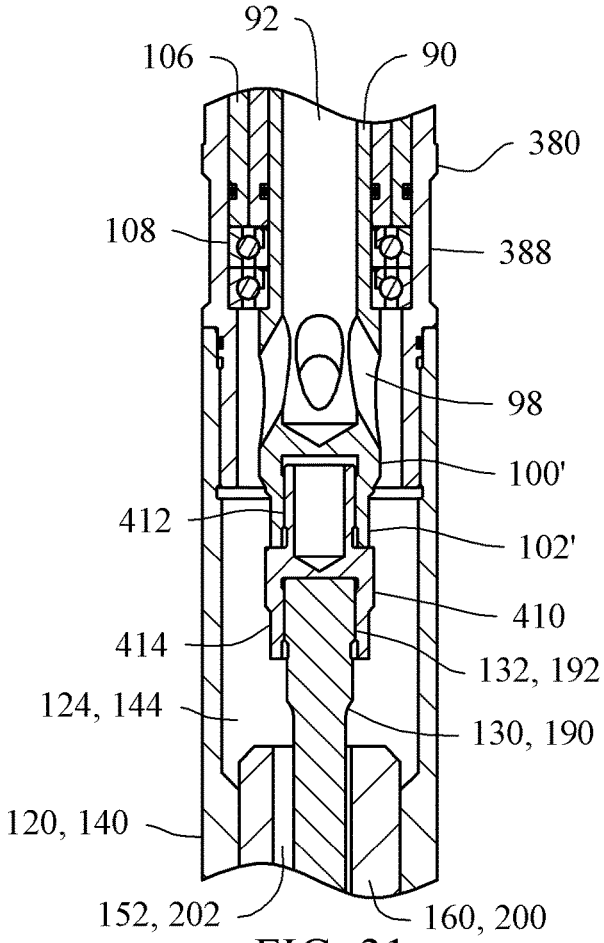
FIG. 31 is a cross-sectional view of the bearing housing assembly and the flex shaft housing assembly with the mandrel and flex shaft of the present technology.

Referring to FIG. 31, the preset technology can utilize shear coupling 410 configured to reliably separate the mandrel 90 from the flex shaft 130, 190, 420. The mandrel 90 can include an alternate second end section 100' featuring a closed off end and exterior planar surfaces. The exterior planar surfaces of the second end section 100' can be arranged to create a geometrical configuration capable of being engaged with a tool for installation, removal or manipulation of the mandrel 90. Adjacent to or part of the second end portion 100' is a second connection end 102' that includes internal or external threading, and is configured to create an annulus between the bearing housing 82, 382 or the flex shaft housing assembly 120, 140.

The shear coupling 410 can include a first end 412 featuring external or internal threading configured to be engageable with the threading of the second connection end 102' when assembled. The shear coupling 410 can further include a second end 414 featuring internal or external threading configured to be engageable with the internal or external threading of the first connection end 132, 192 of the flex shaft 130, 190 when assembled.

Figure 32:
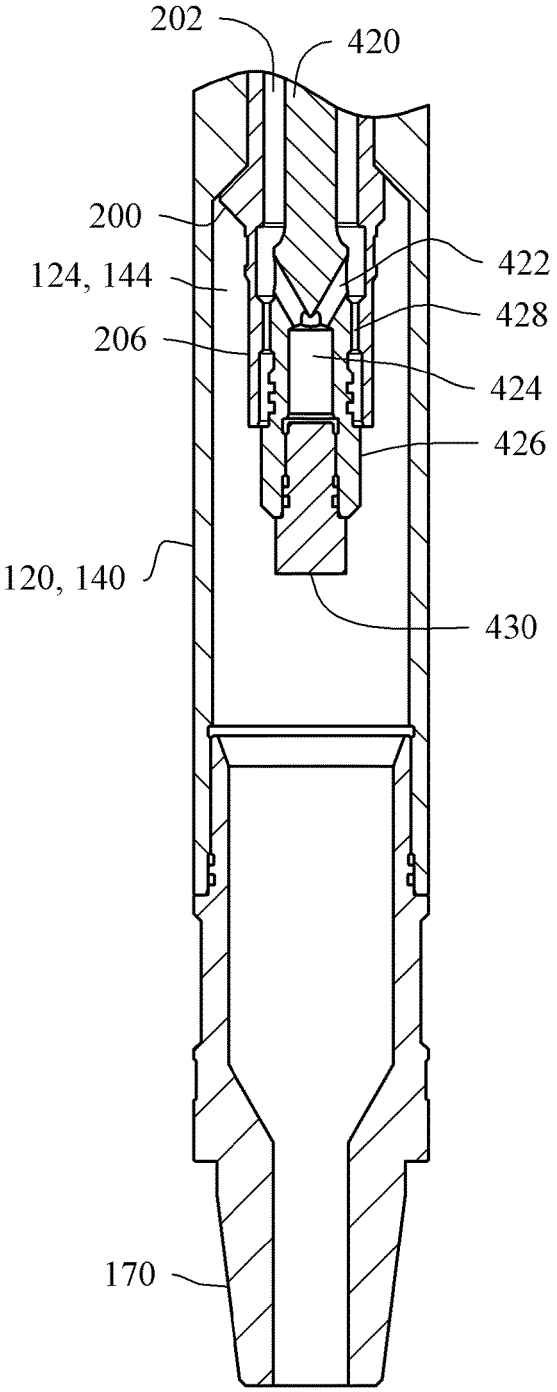
FIG. 32 is a cross-sectional view of an alternate embodiment rotor/stator assembly including an alternate flex shaft and rotor of the present technology.

Referring to FIG. 32, an alternate flex shaft 420 can include the first connection end 192 featuring external threading, the shaft section, and a second connection end 426. The second connection end 426 can include a plurality of radially arranged ports 422 that can be angled to communicate with a second end bore 424 defined in the second connection end 426.

An exterior portion of the second connection end 426 can include a coupling arrangement that is engageable with an internal section of the second connection end 206 of the rotor 200, thereby securing the flex shaft 420 to the rotor 200, while creating an annulus or passage 428 therebetween. The passage 428 allows the working fluid to flow out of the rotor 200 and downstream toward the BHA.

When assembled, the ports 422 are in communication with the axial rotor bore or cavity 202 of the rotor 200, A flex shaft plug 430 can be received in the second end bore 424 as secured thereto by way of a threading arrangement, thereby closing off the second end bore to the stator housing bore or cavity 124, 144.

Under normal operation, being that the progressing-cavity stator/rotor are effectively positive displacement, the rotor will rotate at a rate that is proportional to the volumetric rate of flow travelling between it and the stator, assuming fluid is effectively incompressible.

The rotor is rotationally coupled to the ported mandrel assemble (PMA) by way of the flex shaft. The PMA can include the mandrel, the mandrel cap and associated components.

The PMA is constrained by means of the bearings that permit rotation but limit axial and radial movement. Thus, the mandrel can rotate concentrically within the bearing housing that is rigidly connected in series with the stator and the rest of the BHA.

The flex shaft undergoes nutation as well as rotation at one end due to the rotor's complex motion. At its other end, it delivers pure concentric rotation to the mandrel. In some embodiments, this can be accomplished with the flex shaft having sufficient transverse flexibility. It can be appreciated that other types of drive shafts can be utilized in place of the flex shaft.

Depending on the embodiment, most or all the BHA's fluid flow passes through the port(s) of the mandrel. The port(s) provides a pathway for fluid communication from the annular space, formed between the bearing housing and mandrel, and the interior of the mandrel. The interior of the mandrel cap and the mandrel provides a continuous pathway for fluid flow to continue through to the remaining BHA.

One or more lobe features of the lobed insert, which is rigidly connected to the top sub housing within which the mandrel cap rotates, are in axial alignment with the port(s) of the mandrel cap. As the PMA rotates, the port(s) of the mandrel cap pass by the lobe feature(s) of the constrained lobed insert. The lobe feature(s) is large enough and in sufficient radial proximity to the port(s), to significantly obstruct the passage of fluid into the port(s), as they pass by during rotation.

The lobe feature(s) has a cylindrical surface that is oriented concentrically with respect to the PMA's rotation axis. The port(s) resides on a cylindrical surface that is oriented concentrically with respect to the PMA's rotation axis.

The cyclic obstruction of the port(s) leads to a fluctuating total flow area (TFA). The TFA is at a maximum while the port(s) is completely unobstructed by a lobe feature. The TFA is at a minimum while being fully obstructed by a lobe feature. The cyclic variation of TFA from its maximum to minimum condition causes a pressure spike within the fluid upstream of the port(s). This phenomenon is commonly referred to as "Water Hammer".

The flow rate through the port(s) achieves a maximum ($Q_{max}$) while fully unobstructed and reaches a minimum ($Q_{min}$) while fully obstructed. The magnitude of the pressure spike is proportional to the difference between the maximum and minimum flow rate ($\Delta Q = Q_{max} - Q_{min}$).

The time-averaged flow rate through the port(s) is dependent on the pump rate at surface, which supplies the fluid downhole. Increasing the pump rate increases $\Delta Q$, which in turn increases the pressure spike magnitude.

The rotor's rotational speed is dependent on the pump rate at surface. Increasing the pump rate increases the rotor's rotational speed. Being that the PMA is rotationally coupled to the rotor, increasing the pump rate will increase the pressure spike frequency.

The magnitude of the pressure spike is also proportional to the "system's" hydraulic impedance, which, from an internal pressure perspective, is a measure of the "system's" rigidity. Hydraulic impedance is generally defined as the ratio of pressure to volume flow rate. The pressure and volume flow variables are treated as phasors in this definition, so possess a phase as well as magnitude. The "system" consists of the upstream fluid itself as well as the tubular components (coiled tubing, etc.) though which the upstream fluid is conveyed. The length of the "system" is the product of the "system's" effective speed of sound and the duration of time that the port(s) is obstructed.

In some embodiments, the rotor/stator assembly connects in series into or to the BHA, and does not require any input from other BHA components other than fluid communication.

The bearings associated with the PMA can be cooled and lubricated via bypass fluid flow. The amount of fluid permitted to bypass can be controlled by fluid restrictors. The bypass flow rate ($Q_{bp}$) is substantially smaller than $Q_{min}$.

Some embodiments of the present technology can utilize a dropped object, ball or plug 11, 390, 392, 394 as best illustrated in FIGS. 7A, 28A, 29A and/or 30, wherein the ball activates via the provision of a ball seat defined by the narrowing cavity section 51 of the mandrel cap 50, located at the upstream end of the PMA that defines an opening to a fluid pathway in communication with the PMA's port.

The utilization of a ball can provide an Inactive mode in the absence of a ball and an Active mode in the presence of the ball. In the Inactive mode, the PMA's TFA remains relatively large, even as the port(s) is obstructed. As such, the pressure spike amplitude generated by obstruction of the port(s) is attenuated. In the Active mode, once the ball is seated against the ball seat, the fluid pathway is closed thereby ceasing the attenuation.

The ball that can be dropped or pumped through the wellbore tubulars or coiled tubing 2 to activate a downhole tool or device. The ball can be, but not limited to, a hard non-dissolvable ball, a deformable ball, a dissolvable ball or a destroyable ball. Utilizing a deformable, a dissolvable or a destroyable ball can allow for controlled operation of rotating the mandrel cap 50 and mandrel 90, by obstructing the majority of the fluid flow through the axial cavity of the mandrel cap 50 and mandrel 90 and thus through the stator and rotor assembly 140. When agitation is required, pressure could be increased to deform the ball through the narrowing cavity section 51 of the mandrel cap 50 allowing the ball to travel until contact is made with the first connection end 132 of the flex shaft 130. Alternatively, the ball can be made of a dissolvable material that is configured to dissolve by the fluid after a predetermined time.

In some embodiments, the PMA can be driven by a rotor of a drilling motor situated directly downstream of the present technology system. The drilling motor's rotor catch function should be retained. For this reason, the flex shaft is rotationally coupled to a modified rotor catch device rather than directly to the rotor itself. As well, the flex shaft housing threadably connects to a top sub of the drilling motor rather than the stator itself. The top sub of the drilling motor can furnish an internal shoulder feature, which is essential to the rotor catch function.

The PMA bearings of the present technology are configured to not axially constrain or limit the axial movement of the rotor, which is already constrained by a bearing pack of the drilling motor. As such, an expansion/retraction (telescoping) feature can be provided at some location in between the rotor and the PMA's bearings.

Some embodiments of the present technology can include the rotor/stator assembly as being installed in series within an existing drilling motor, which does not require modifications to any of the drilling motors components. The PMA is rigidly connected in series with a flex shaft and bearing mandrel of the drilling motor. Therefore, the PMA does not require dedicated bearing support since the bearing mandrel is already well supported by the drilling motor's bearings.

Further, because the PMA is rigidly connected to the flex shaft, its rotation is provided via the drilling motor's power section. For this reason, a dedicated means of rotating the PMA, such as a dedicated power section and/or driveshaft, is not required either.

As a further consequence of being rigidly connected in series with the flex shaft and bearing mandrel of the drilling motor, the PMA can be of sufficient torsional strength to reliably transmit the relatively high torque that a drilling motor's drive-line is subject to.

If the drilling motor is of the sealed bearing variety, all fluid flow will pass through the PMA's port(s). If the drilling motor is of the "mud-lube" variety, then some fluid flow will bypass through the motor's bearing stack.

A housing can be threadably connected between the flex shaft and bearing mandrel of the drilling motor, of make-up length corresponding to the PMA's make-up length can be provided to maintain correct alignment of the drilling motor's drive-line components. As well, this housing can provide a means to secure the lobe feature(s).

It can be appreciated that the PMA may terminate any pre-existing flow paths leading from the drive-shaft. For example, often flow is routed to the bearing mandrel's central flow pathway via substantially radial ports located on the drive-shaft.

In some embodiment, the radial clearance between ported sleeve and lobed insert controls pulsation magnitude being: a smaller clearance=larger pulsation magnitude; and a larger clearance=smaller pulsation magnitude.

The present technology can be configured accordingly: for larger pulsation amplitude: install a ported sleeve with larger outer diameter (OD) to provide a smaller clearance; and for smaller pulsation amplitude: install a ported sleeve with smaller OD to provide a larger clearance.

The number of lobes of the stator and/or rotor can vary, depending on predetermined requirements or characteristics. For example, prior to deployment of the present technology down the wellbore, an operator can install a lobed insert with desired number of lobes. Generally, the number of lobe features of the lobed insert will be one or two. In the case of two lobes, they can be phased at 180°. It can be appreciated that the more lobes results in a higher frequency of pulsation.

Frequency of pulsations equals product of PMA's revolutions per second and number of lobe features of the lobe insert, assuming angular positioning of lobes and ports are such that all ports are obstructed simultaneously.

Number of ports of the ported sleeved and/or mandrel cap should not exceed number of lobe features of the lobe insert. Otherwise, a port will always be left unobstructed, leading to significant attenuation of pulsation magnitude.

The angular span of the lobe feature of the lobe insert can be configurable, by selecting a lobed insert having desired lobe angular span, with a larger angular span=larger pulsation amplitude. A larger lobe angular span reduces the length of time over which the port(s) of the ported sleeve is unobstructed. As such, $Q_{max}$ and, by extension, $\Delta Q$ will increase thereby increasing pulsation magnitude.

While a larger lobe span will increase pulsation amplitude, it will also increase the mean pressure drop across the tool. As such, the required pumping horsepower increases at any given flow rate.

Thus, it can be appreciated that the frequency of the pulsation created by the present technology can be adjusted and/or controlled easily by utilizing lobe inserts featuring specific lobe feature characteristics, and/or utilizing ported sleeves and mandrel caps having specific port(s) characteristics.

In some embodiments, the valve sub assembly of the present technology can replace the motor catch, and therefore the bottom section of the present technology will be the top section of the motor.

In some embodiments, the valve sub assembly of the present technology can be attachable to any known or standardized rotor/stator assembly, thereby proving controllable pulsation to existing units.

While embodiments of the downhole pulsation system and method have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although reducing friction acting on a tool string by generating and utilizing pressure pulsations have been described, it should be appreciated that the downhole pulsation system and method herein described is also suitable for providing vibration to any part of a drill string or BHA.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A valve system comprising:

a mandrel cap at least partially receivable in a sub bore of a valve sub housing that is operably associated with a drill string and configured to receive a fluid from the drill string, said mandrel cap including a cap bore extending along a longitudinal axis therethrough; and a valve including a first end section, a valve bore defined along a longitudinal axis therethrough, one or more ports defined laterally through a sidewall of said valve and in communication with said valve bore, and a second end section defining one or more cavity sections in communication with said valve bore, wherein at least a portion of said valve being receivable in said cap bore, and said valve bore being configured to receive fluid from said sub bore or the drill string;

wherein said second end section includes a ring wall separating said cavity sections into an outer cavity and a central bore interiorly concentric with said outer cavity, said outer cavity and said central bore being in communication with said valve bore, said ring wall being configured to seat against a first object traveling from the drill string to prevent fluid flow entering said central bore;

wherein said cavity sections being configured between an open position allowing fluid to pass therethrough and a closed position preventing fluid to pass therethrough.

2. The valve system of claim 1, wherein said valve bore includes a narrowing section located between said ports and said second end section, said narrowing section being configured to seat against a second object traveling from the drill string to prevent fluid flow entering said outer cavity and said central bore.

3. The valve system of claim 2, wherein said narrowing section has a width or diameter greater than a width or diameter of said ring wall.

4. The valve system of claim 1, wherein said valve includes a first unit receivable in said cap bore, and a second unit being at least partially receivable in said cap bore, and wherein said first unit including said cavity sections, and said second unit including said ports.

5. The valve system of claim 4, wherein said cap bore includes an internal stop edge configured to fix said first unit at a location.

6. The valve system of claim 5, wherein said second unit being configured to engage with said mandrel cap to secure said second unit to said mandrel cap and said first unit against said internal stop edge.

7. The valve system of claim 1 further comprises a lobed insert fittable to said valve sub housing and locatable inside said sub bore or receivable inside an axial bore of a second housing that is attachable to said valve sub housing, said lobed insert including an insert bore axially extending along a longitudinal axis therethrough and configured to allow fluid to pass therethrough, and at least one lobe feature extending into said insert bore.

8. The valve system of claim 7, wherein said mandrel cap includes at least one mandrel cap port defined through said mandrel cap and in communication with said cap bore, said mandrel cap having a portion thereof receivable in said insert bore of said lobed insert so that said at least one mandrel cap port is alignable with said at least one lobe feature.

9. The valve system of claim 8, wherein said lobed insert or said mandrel cap being configured to intermittently allow fluid or portion of the fluid to pass from said insert bore through said at least one mandrel cap port upon rotation of said mandrel cap by a rotating assembly.

10. The valve system of claim 9, wherein said rotating assembly is a rotor of a rotor and stator assembly.

11. The valve system of claim 1 further comprising a mandrel connectable to said mandrel cap, said mandrel including a mandrel bore axially extending along a longitudinal axis therethrough and configured to allow fluid to pass therethrough, and at least one mandrel port defined through said mandrel in communication with said mandrel bore and configured to allow fluid to pass from said mandrel bore to an annulus defined exterior of at least a portion of said mandrel defining said at least one mandrel port.

12. The valve system of claim 11, wherein said mandrel is rotatably supported inside said sub bore of said valve sub housing or inside an axial bore of a second housing that is attachable to said valve sub housing, said mandrel being rotatably support by way of one or more bearings.

13. The valve system of claim 1 further comprising a sleeve including a sleeve bore axially extending along a longitudinal axis therethrough, and at least one sleeve port defined through said sleeve in communication with said sleeve bore, said sleeve bore being configured to receive a portion of said mandrel cap defining a mandrel cap port so that said at least one sleeve port is aligned with and in communication with said mandrel cap port when said sleeve is assembled on said mandrel cap.

14. The valve system of claim 13 further comprising a collar including a collar bore axially extending along a longitudinal axis therethrough and configured to receive said mandrel cap and secure said sleeve in position on said mandrel cap.

15. The valve system of claim 13, wherein said sleeve includes at least one sleeve notch defined in an end of said sleeve, said mandrel cap includes at least on cap notch defined in an exterior surface of said mandrel cap, and wherein said at least one sleeve notch and said at least one cap notch being configured to receive a member to prevent rotation of said sleeve about said mandrel cap.

16. A valve system utilizable with a downhole pulsation assembly, said valve system comprising:

a mandrel cap at least partially receivable in a sub bore of a valve sub housing that is operably associated with a drill string and configured to receive a fluid from the drill string, said mandrel cap including a cap bore extending along a longitudinal axis therethrough;

a valve assembly comprising:

a first unit receivable in said cap bore, said first unit including a first end section, a first unit bore along a longitudinal axis therethrough, and a second end section defining one or more cavity sections in communication with said first unit bore, said cavity sections of said first unit being configured between an open position allowing fluid to pass therethrough and a closed position preventing fluid to pass therethrough; and a second unit being at least partially receivable in said cap bore, said second unit including a first end section, a second unit bore defined along a longitudinal axis therethrough, one or more ports defined laterally through a sidewall of said second unit and in communication with said second unit bore, and a second end section; and a pulsation assembly comprising:

a rotor operably linked to said mandrel cap, said rotor having at least one rotor lobe; and a stator including a stator bore axially extending along a longitudinal axis therethrough and configured to allow fluid to pass therethrough, and at least one stator lobe, said stator bore being configured to receive said rotor;

wherein said second end section includes a ring wall separating said cavity sections into an outer cavity and a central bore interiorly concentric with said outer cavity, said outer cavity and said central bore being in communication with said valve bore, said ring wall being configured to seat against a first object traveling from the drill string to prevent fluid flow entering said central bore.

17. The valve system of claim 16, further comprises:

a mandrel connectable to said mandrel cap, said mandrel including a mandrel bore axially extending along a longitudinal axis therethrough and configured to allow fluid to pass therethrough from said cap bore, and at least one mandrel port defined through said mandrel in communication with said mandrel bore and configured to allow fluid to pass from said mandrel bore to an annulus defined exterior of at least a portion of said mandrel defining said at least one mandrel port; and a lobed insert fittable to said valve sub housing and locatable inside said sub bore, said lobed insert including an insert bore axially extending along a longitudinal axis therethrough and configured to allow fluid to pass therethrough, and at least one lobe feature extending into said insert bore;

wherein said mandrel cap including at least one mandrel cap port defined through said mandrel cap in communication with said cap bore, said mandrel cap having a portion thereof rotatably receivable in said insert bore of said lobed insert so that said at least one mandrel cap port is alignable with said at least one lobe feature.

18. A method of using a valve system, said method comprising the steps of:

a) providing a valve system comprising:

a mandrel cap at least partially receivable in a sub bore of a valve sub housing that is operably associated with a drill string, said mandrel cap including a cap bore extending along a longitudinal axis therethrough; and a valve including a first end section, a valve bore defined along a longitudinal axis therethrough, one or more ports defined laterally through a sidewall of said valve and in communication with said valve bore, and a second end section defining one or more cavity sections in communication with said valve bore, wherein at least a portion of said valve being receivable in said cap bore, wherein said second end section including a ring wall separating said cavity sections into an outer cavity and a central bore interiorly concentric with said outer cavity, said outer cavity and said central bore being in communication with said valve bore;

b) receiving a working fluid from the drill string to said valve bore defined through said valve associated with said valve sub housing that is connected to the drill string;

c) providing said valve in a configuration selected from the group consisting of:

a full by-pass configuration where the working fluid is allowed to flow through said valve into said cap bore defined in said mandrel cap that is attachable to said valve;

a partial by-pass configuration where a first object is receivable from the drill string into said valve bore to contact said ring wall defining said central bore in said valve that is in communication with said valve bore, so that the first object prevents the working fluid from exiting said central bore while allowing a portion of the working fluid to pass around said central bore by way of said outer cavity defined in said valve and in communication with said valve bore; and a no by-pass configuration where said first object is in contact with said ring wall, and where a second object is receivable from the drill string into said valve bore to prevent the working fluid from entering said outer cavity; and d) flowing at least a portion of the working fluid through said one or more ports defined laterally through said sidewall of said valve and in communication with said valve bore to an annulus defined exterior of said valve.

* * * * *